US008936332B2

(12) United States Patent
Park et al.

(10) Patent No.: US 8,936,332 B2
(45) Date of Patent: Jan. 20, 2015

(54) REFRIGERATOR

(71) Applicants: Kyutae Park, Seoul (KR); Kyungsoo Park, Seoul (KR); Seonkyu Kim, Seoul (KR); Hyokku Kwon, Seoul (KR); Hangbok Lee, Seoul (KR)

(72) Inventors: Kyutae Park, Seoul (KR); Kyungsoo Park, Seoul (KR); Seonkyu Kim, Seoul (KR); Hyokku Kwon, Seoul (KR); Hangbok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 13/625,447

(22) Filed: Sep. 24, 2012

(65) Prior Publication Data

US 2013/0081422 A1 Apr. 4, 2013

(30) Foreign Application Priority Data

Oct. 4, 2011 (KR) ..... 10-2011-0100893
Oct. 5, 2011 (KR) ..... 10-2011-0101497
Oct. 6, 2011 (KR) ..... 10-2011-0102090

(51) Int. Cl.
*A47B 96/00* (2006.01)
*F25D 11/00* (2006.01)

(52) U.S. Cl.
CPC ..... *F25D 11/00* (2013.01)
USPC ..... 312/408; 312/404; 62/382

(58) Field of Classification Search
CPC ..... F25D 25/02; F25D 25/021; F25D 25/025
USPC ..... 312/401, 402, 404, 408, 410, 330.1, 312/331, 351; 62/382; 108/107, 108, 143
See application file for complete search history.

(56) References Cited

U.S. PATENT DOCUMENTS

| | | | | |
|---|---|---|---|---|
| 2,317,232 | A * | 4/1943 | Swedman | 312/271 |
| 2,465,806 | A * | 3/1949 | Jewell | 211/153 |
| 3,859,932 | A * | 1/1975 | Armstrong et al. | 108/75 |
| 4,528,825 | A * | 7/1985 | Khan | 62/441 |
| 5,980,009 | A * | 11/1999 | Atalla et al. | 312/408 |
| 8,403,438 | B2 * | 3/2013 | Park et al. | 312/408 |
| 2004/0164654 | A1 * | 8/2004 | Laible | 312/122 |
| 2005/0145704 | A1 * | 7/2005 | Hwang | 236/44 A |
| 2006/0125362 | A1 * | 6/2006 | Kim | 312/408 |
| 2007/0176528 | A1 * | 8/2007 | Lee et al. | 312/408 |
| 2007/0262686 | A1 * | 11/2007 | Ji | 312/402 |
| 2009/0058247 | A1 * | 3/2009 | Collins et al. | 312/408 |

* cited by examiner

*Primary Examiner* — James O Hansen
(74) *Attorney, Agent, or Firm* — McKenna Long & Aldridge

(57) ABSTRACT

A refrigerator includes a refrigerator main body having a cooling chamber, a cooling chamber door configured to open and close the cooling chamber, a rear storage member disposed at a rear area to be drawn out along back and forth directions of the cooling chamber, and a front storage member disposed at the front of the rear storage member and configured to be relatively movable with respect to the rear storage member, whereby goods and/or food stuffs can be easily stored and drawn out.

20 Claims, 23 Drawing Sheets

REFRIGERATOR

CROSS-REFERENCE TO RELATED APPLICATION

The present disclosure relates to subject matter contained in priority Korean Application Nos. 10-2011-0100893 filed on Oct. 4, 2011, 10-2011-0101497 filed on Oct. 5, 2011, and 10-2011-0102090 filed on Oct. 6, 2011, which are herein expressly incorporated by reference in their entireties.

BACKGROUND OF THE INVENTION

1. Field of the Invention

This specification relates to a refrigerator, and particularly, to a refrigerator capable of facilitating goods and/or food stuffs to be stored in or drawn out of a cooling chamber.

2. Background of the Invention

As well known, a refrigerator is a machine for keeping goods or food stuffs in a refrigerated or frozen state.

The refrigerator includes a refrigerator main body having a cooling chamber, a cooling chamber door installed at the refrigerator main body to open and close the cooling chamber, and a refrigeration cycle system (apparatus) capable of supplying cold air to the cooling chamber.

FIG. 1 is a view showing an example of the related art refrigerator, and FIG. 2 is a view showing a tray disposed in a cooling chamber of FIG. 1.

As shown in FIG. 1, the refrigerator includes a refrigerator main body 10 having a cooling chamber 20, and a cooling chamber door 30 for opening and closing the cooling chamber 20.

The cooling chamber 20 includes a freezing chamber 21 and a refrigerating chamber 22, for example.

The cooling chamber door 30 includes a freezing chamber door 31 for opening and closing the freezing chamber 21, and a refrigerating chamber door 32 for opening and closing the refrigerating chamber 22.

The refrigerator main body 10 includes a refrigeration cycle system for supplying cold air to the cooling chamber 20.

The refrigeration cycle system may be implemented as a so-called vapor compression type refrigeration cycle system having a compressor for compressing a refrigerant, a condenser for condensing the refrigerant, an expansion apparatus for decompressing and expanding the refrigerant, and an evaporator for evaporating the refrigerant with latent heat absorbed therein.

In the meantime, shelves for partitioning an inner space into upper and lower spaces may be disposed in the cooling chamber 20.

The shelves 35 may be disposed with preset heights and intervals within the freezing chamber 21 and the refrigerating chamber 22.

The cooling chamber 20 may include trays 40 for storing foods.

The tray 40 may be formed in a shape of a box having an upper opening.

The tray 40, for example, referring to FIG. 4, may be disposed at a lower portion of each shelf 35. Accordingly, when the tray 40 is retracted (pushed in), the upper opening of the tray 40 may be shielded.

Tray supporting units 45 for allowing the tray 40 to be slidable back and forth are disposed at both sides of the tray 40.

Each tray supporting unit 45 includes a roller 47 for supporting the tray 40.

The tray 40 includes rails 42 each contacting an upper surface of the corresponding roller 47 to be slidable back and forth.

A support roller (not shown) rollable on an upper surface of the rail 42 may be provided on each rail 42.

By the way, a lower area of the refrigerating chamber 22 is shown having drawers 50 for storing vegetables, fruits and the like. A drawer 51*a*, which is disposed at the lowermost of the refrigerating chamber 22, of the drawers 50, may protrude toward the front of the refrigerating chamber 22, increasing a storage space of the drawer 51*a*.

A cover 60 for obscuring an upper opening of the lower drawer 51*a* is disposed on the lower drawer 51*a*.

The cover 60 may be upwardly rotatable based on a rotational shaft 61 upon drawing (pulling) the lower drawer 51*a* out.

However, in the related art refrigerator having the configuration, in order to support the tray 40 upon pulling the tray 40 out, the tray 40 may not be fully pulled out of the tray supporting units 45. This may make it difficult to put foods in and/or take such foods out of a rear area within the tray 40. Especially, when foods relatively small in size are stacked in the tray 40 for storage, it may be relatively difficult for a user (for example, user's hand) to reach the rear area of the tray 40, causing difficulty in storing and/or picking up foods.

Also, the shelves 35 are installed in the longitudinal direction with the preset heights and intervals. Hence, when a food stuff longer than the interval between the shelves 35 has to be stored, foods already placed on the upper shelf 35 are first taken away, the upper shelf 35 is detached and then the long food is put on the lower shelf 35. This causes burden of storage.

Furthermore, since the cover 60 is rotated up when the lower drawer 51*a* is pulled out, pulling the upper drawer 51*b* is interrupted. Especially, when the upper drawer 51*b* is pulled out in a state that the cover 60 has been rotated up, the cover 60 and the upper drawer 51*b* may be subject to damage.

SUMMARY OF THE INVENTION

Therefore, to overcome the shortcomings of the related art, an aspect of the detailed description is to provide a refrigerator capable of facilitating storing and drawing out goods and/or foods.

Another aspect of the detailed description is to provide a refrigerator capable of facilitating storing foods in and drawing foods out of a tray.

Another aspect of the detailed description is to provide a refrigerator capable of utilizing a rear space by virtue of fully drawing out a tray.

Another aspect of the detailed description is to provide a refrigerator capable of facilitating storing foods in and drawing foods out of a drawer.

Another aspect of the detailed description is to provide a refrigerator having shelves capable of storing foods in and drawing foods out.

To achieve these and other advantages and in accordance with the purpose of this specification, as embodied and broadly described herein, there is provided a refrigerator including a refrigerator main body having a cooling chamber, a cooling chamber door configured to open and close the cooling chamber, a rear storage member disposed at a rear area to be drawn out along back and forth directions of the cooling chamber, and a front storage member disposed at the front of the rear storage member and configured to be relatively movable with respect to the rear storage member.

Here, the rear storage member and the front storage member may be implemented as a rear tray and a front tray each having a storage space therein, and the refrigerator may further include connection links configured to connect the front tray to the rear tray to be movable up and down.

The connection links may be disposed at both sides of each of the front tray and the rear tray. Each of the connection links may include a rear link having one end connected to the rear tray and the other end connected to the front tray, and a front link disposed at the front of the rear link and having both end portions connected to the rear tray and the front tray, respectively.

The refrigerator may further include rails configured to guide the rear tray and the front tray back and forth, and each of the rails may include a fixed rail fixed to the cooling chamber, and a movable rail retractably coupled to the fixed rail.

The front tray may include front link receiving portions for insertion of front end portions of the rear link and the front link, respectively, and the rear tray may include rear link receiving portions for insertion of rear end portions of the rear link and the front link, respectively.

The front tray may be slid forward rather than the movable rail and moved to a lower side of the rear tray.

The front link may include a horizontal section extending from a connection end portion of the rear tray to the front tray, and an inclined section inclined from the horizontal section to a connection end portion of the front tray. The rear link may include an inclined section upwardly inclined from the connection end portion of the rear tray, and a horizontal section horizontally extending from the inclined section toward the connection end portion of the front tray.

The rear link and the front link may contact each other to support the front tray when the front tray is moved down.

Contact surfaces may be formed at a lower end of the rear link and an upper end of the front link, respectively.

The rear storage member may be implemented as a rear shelf disposed at a rear area of the cooling chamber. The front storage member may be implemented as a front shelf movable between a support position of being disposed at the front area of the rear shelf and a retraction position of being disposed below the rear shelf. Here, the refrigerator may further include support members configured to support the front shelf and the rear shelf.

Each of the support members may include a guide portion configured to guide the front shelf from the support position to the retraction position.

A plurality of protrusions may be formed on a lower surface of the rear shelf, and protrusion receiving portions for insertion of the protrusions therein may be formed on the support members.

The protrusions may include front protrusions formed on a front area of the rear shelf, and rear protrusions formed on a rear area of the rear shelf.

The rear shelf may be perpendicularly rotatable based on the rear protrusions.

A single plate-shaped shelf may be disposed above or below the rear shelf and the front shelf.

The shelf, the rear shelf and the front shelf may be formed of a rigid material.

The shelf, the rear shelf and the front shelf may be formed of glass, and each of them may have a corrosion-processed portion formed by perform corrosion processing with respect to one surface thereof.

The refrigerator may further include a drawer disposed in the cooling chamber, a cover disposed on the drawer, and a cover driving unit configured to allow the cover to be slidable upon drawing the drawer out.

The cover driving unit may include a pinion, a first rack disposed on the drawer and engaged with the pinion, and a second rack disposed on the cover and engaged with the pinion.

The cover driving unit may include a belt connected to the cover and the drawer, respectively, and a plurality of pulleys configured to movably support the belt.

The cover driving unit may include a power transfer piece having one side connected to the belt and the other side protruding toward the drawer, and the drawer may have a non-contact section which is non-contactable with the power transfer piece along a rotating direction of the belt.

The refrigerator may further include drawer supporting units configured to movably support the drawer, and each of the drawer supporting units may include a drawer support roller, and a drawer support rail configured to allow the drawer support roller to be rollable so as to perform a relative motion therewith.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
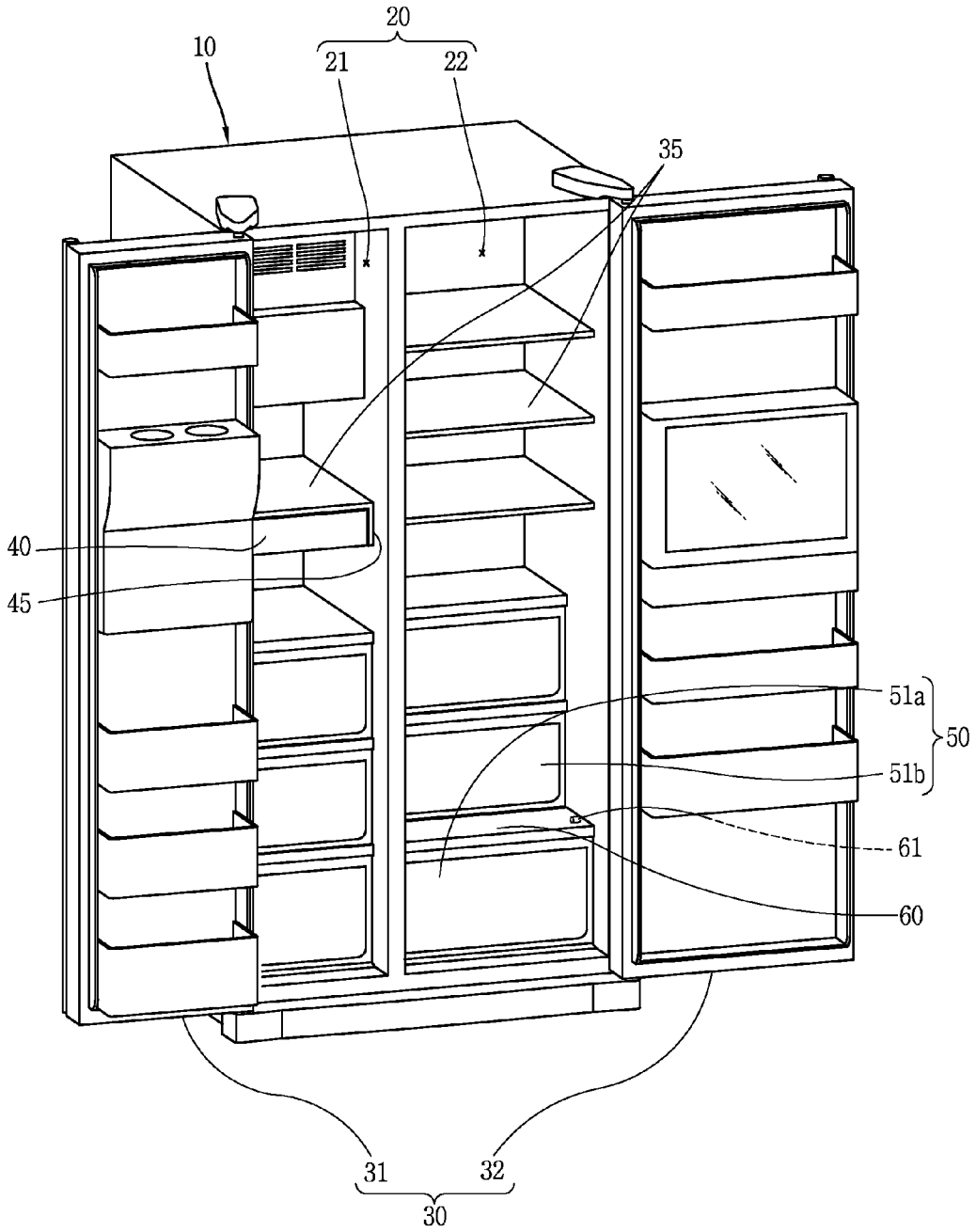
FIG. 1 RELATED ART
FIG. 1 is a view showing an example of a refrigerator according to the related art.
Figure 2:
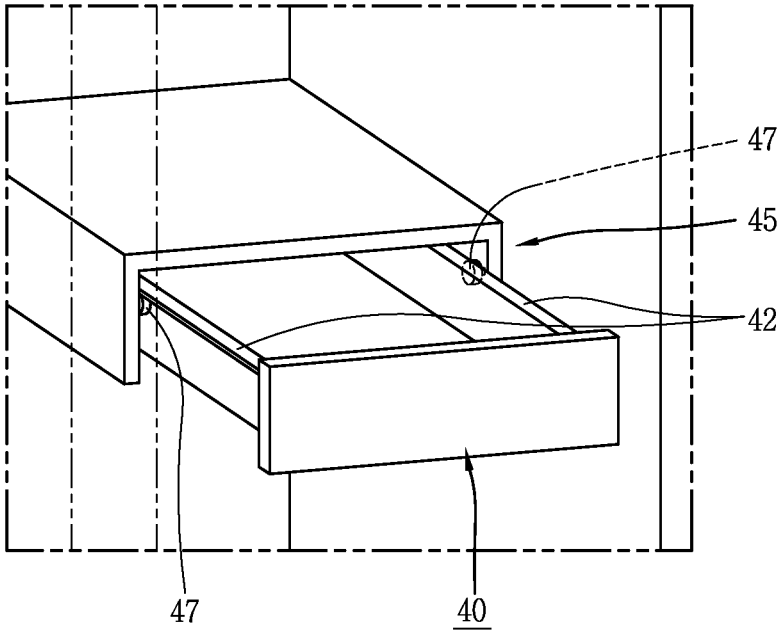
FIG. 2 RELATED ART
FIG. 2 is a view showing a tray disposed in a freezing chamber of FIG. 1.
Figure 3:
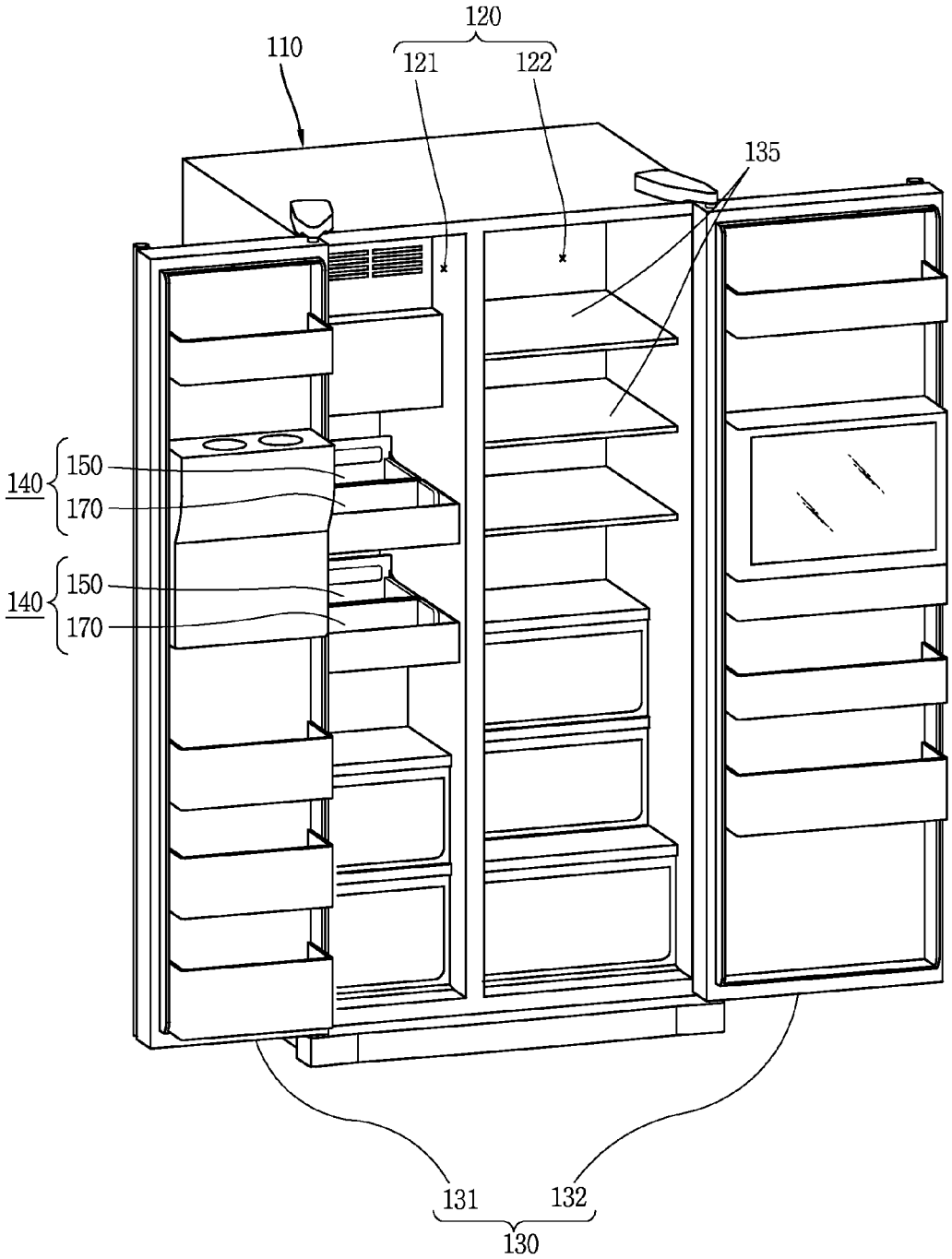
FIG. 3 is a perspective view of a refrigerator in accordance with one exemplary embodiment.

As shown in FIG. 3, a refrigerator according to one exemplary embodiment may include a refrigerant main body 110 having a cooling chamber 120, a cooling chamber door 130 for opening and closing the cooling chamber 120, a rear storage member disposed at a rear area of the cooling chamber 120 to be drawn out in a back-and-forth direction of the cooling chamber 120, and a front storage member disposed at the front of the rear storage member to be relatively movable with respect to the rear storage member. Here, the cooling chamber 120 may include both a freezing chamber 121 and a refrigerating chamber 122, and the refrigerator main body 110 may include one of the freezing chamber 121 or the refrigerating chamber 122.

The rear storage member and the front storage member may be implemented respectively as a rear tray 150 and a front tray 170 each having storage space therein.

A plurality of cooling chambers 120 may be disposed within the refrigerator main body 110.

The cooling chamber 120 may include a freezing chamber 121 and a refrigerating chamber 122.

A cooling chamber door 130 for opening and closing the cooling chamber 120 may be disposed at one side (front surface) of the cooling chamber 120.

The cooling chamber door 130 may include a freezing chamber door 131 for opening and closing the freezing chamber 121, and a refrigerating chamber door 132 for opening and closing the refrigerating chamber 122.

A plurality of shelves 135 may be disposed within the cooling chamber 120, partitioning an inner space of each cooling chamber 120 into upper and lower spaces. Foods may be put on an upper surface of each shelf 135.

Meanwhile, a plurality of trays 140 may be disposed within the cooling chamber 120.

The trays 140 may be disposed in each of the freezing chamber 121 and the refrigerating chamber 122.

Each tray 140, for example, may include a rear tray 150 located in a rear area of the cooling chamber 120 to be drawn out in a back-and-forth direction of the cooling chamber 120, a front tray 170 located at the front of the rear tray 150 based on a path of pulling out the rear tray 150, and connection links 249 for connecting the front tray 170 to be movable up and down with respect to the rear tray 150. Here, the trays 140 may further include a single tray (not shown) in a shape of a box having an upper opening and having a length longer than the front tray 170 and the rear tray 150 in back and forth directions.

The rear tray 150 and the front tray 170 may be provided in each of the freezing chamber 121 and the refrigerating chamber 122.

Hereinafter, description will be given of an example that the rear tray 150 and the front tray 170 are disposed in the freezing chamber 121.

The rear tray 150 and the front tray 170 may be disposed at the same height from a bottom of the freezing chamber 121 (i.e., to be flush with each other) at a retraction (receiving) positions thereof.

Figure 4:
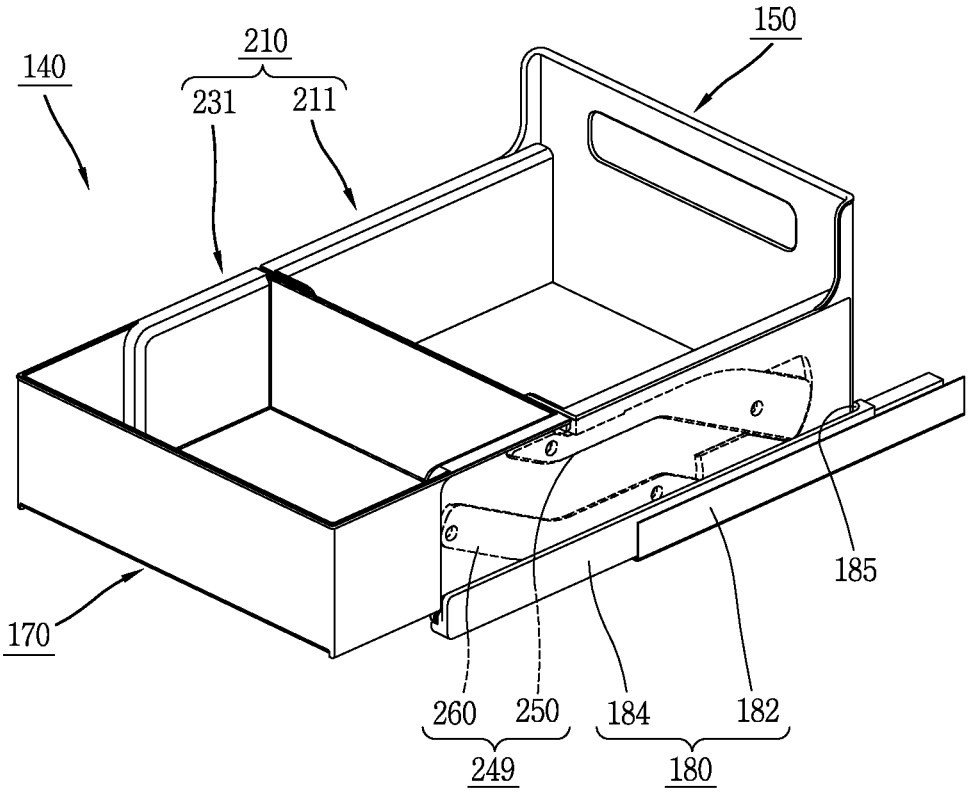
FIG. 4 is a perspective view of a tray shown in FIG. 3.
Figure 5:
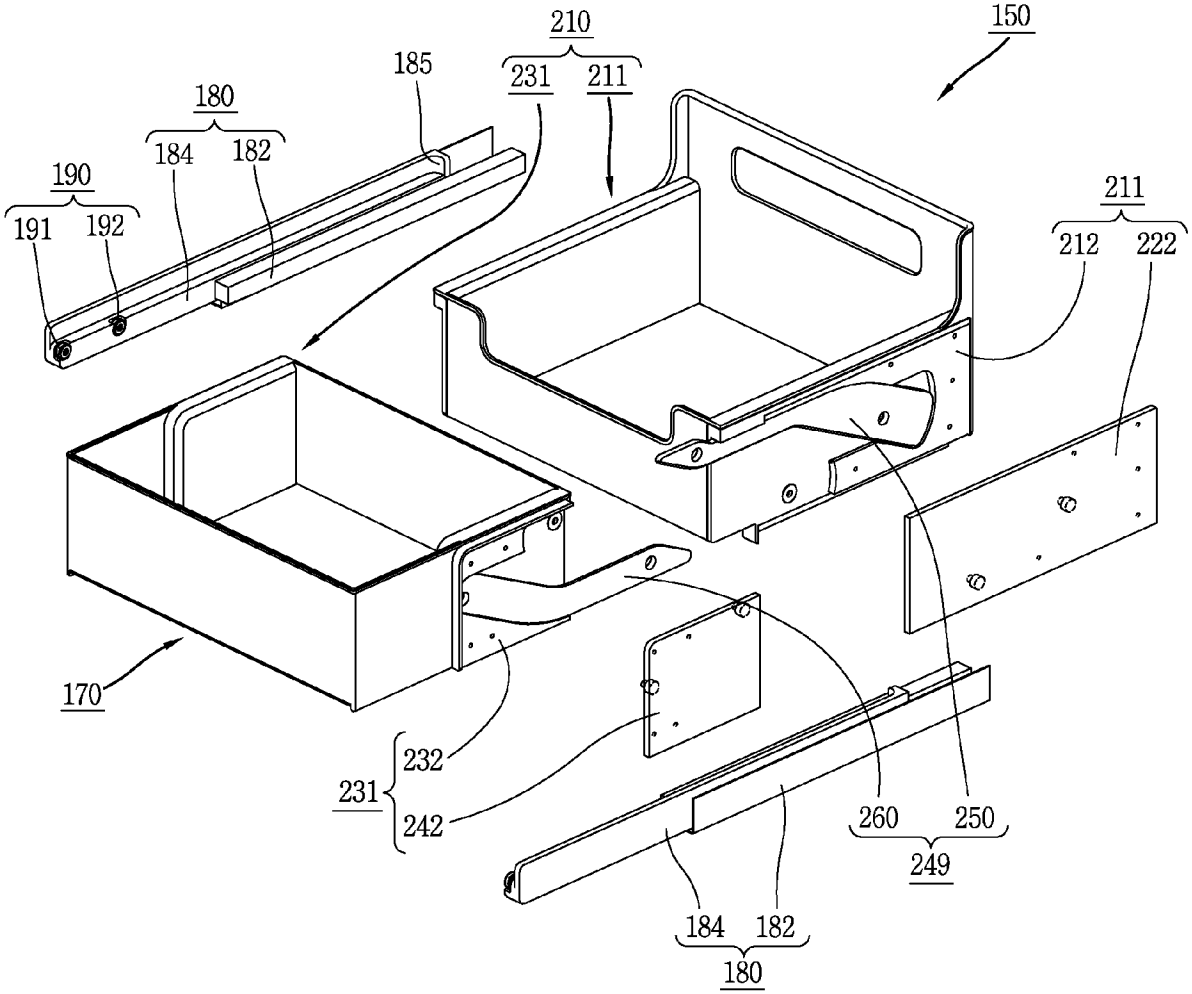
FIG. 5 is a disassembled perspective view of the tray shown in FIG. 4.
Figure 6:
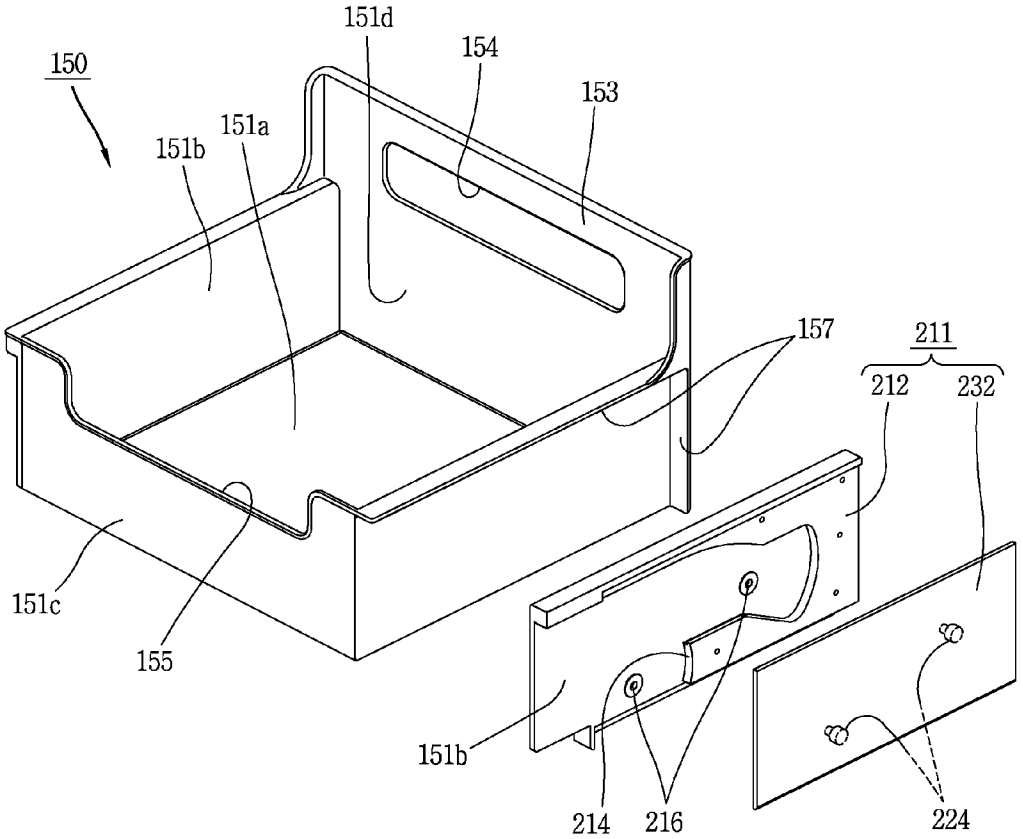
FIG. 6 is a perspective view of a rear tray shown in FIG. 5.

The rear tray 150, as shown in FIGS. 4 to 6, may have a shape of a box with an upper opening. In more detail, the rear tray 150 has a shape of a rectangular box having an upper opening.

The rear tray 150 may include a lower plate 151*a*, both side plates 151*b* perpendicularly disposed at both sides of the lower plate 151*a*, and front and rear plates 151*c* and 151*d* perpendicularly disposed at front and rear sides of the lower plate 151*a*.

A rear end portion of the rear tray 150 may be shown having an anti-falling portion 153 upwardly protruding rather than other portions (for example, the front plate 151*c* or the side plates 151*b*). The anti-falling portion 153 may prevent foods stored within the rear tray 150 from being fallen behind the rear tray 150. Here, the anti-falling portion 153 may be formed integrally with the rear plate 151*d*. The anti-falling portion 153 may be coupled to the rear plate 151*d*.

The anti-falling portion 153 may include a through hole 154.

A cut portion 155 may be formed at the front plate 151*c* of the rear tray 150 by cutting off the front plate 151*c* by a predetermined height. This may facilitate viewing of the inner space of the rear tray 150.

The front tray 170 may have a shape of a box with an upper opening, for example.

In more detail, the front tray 170 may have a shape of a rectangular box with an upper opening.

Figure 7:
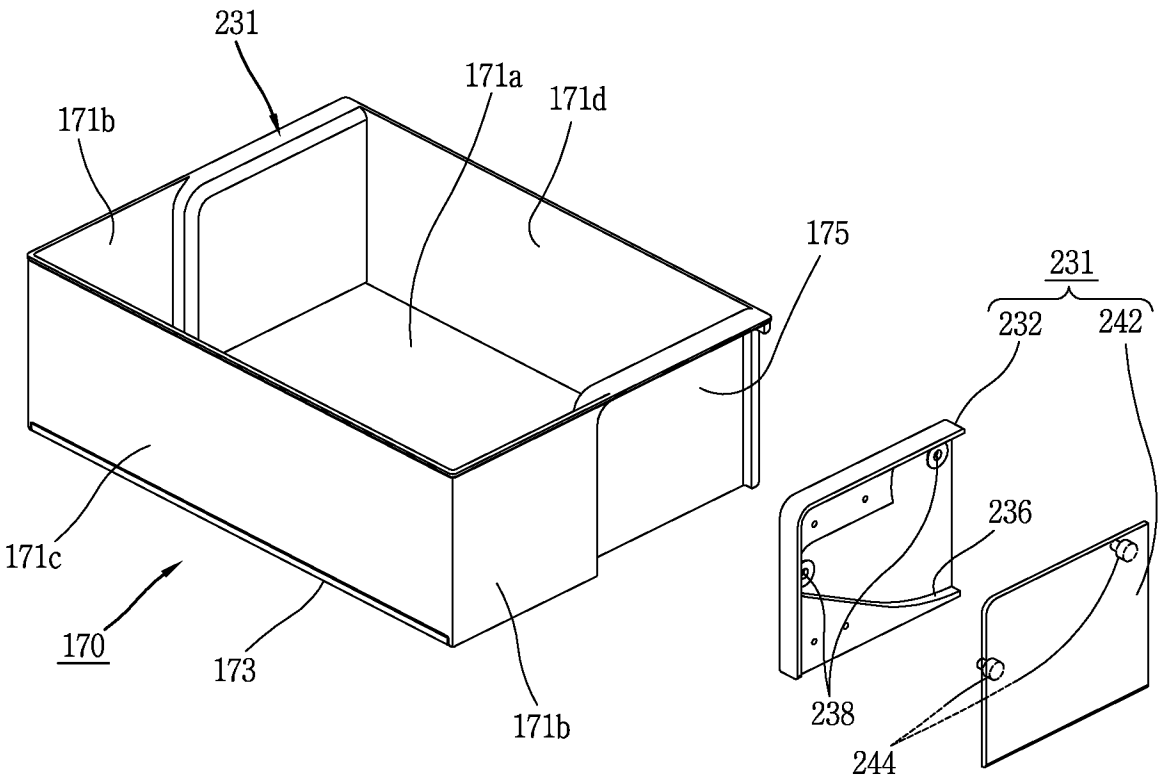
FIG. 7 is a perspective view of a front tray shown in FIG. 5.
Figure 8:
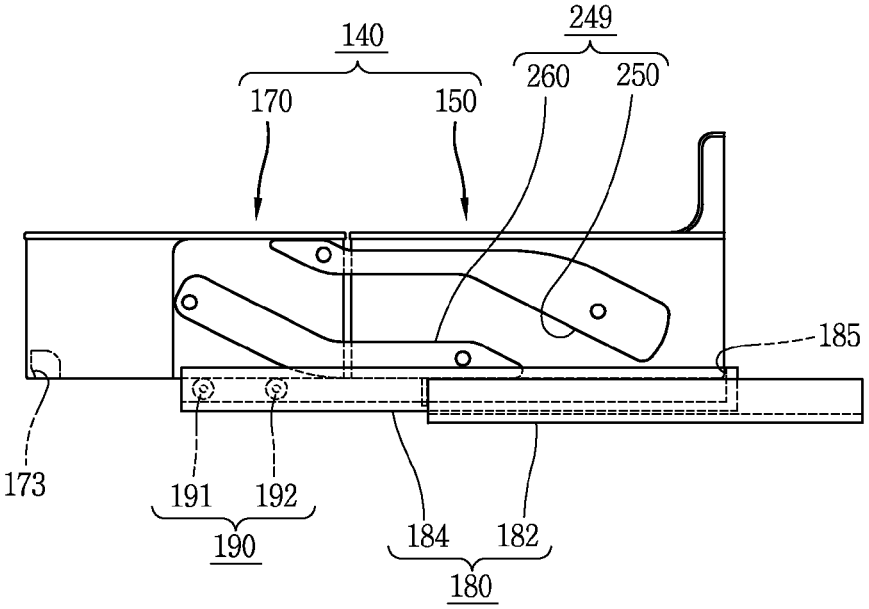
FIG. 8 is a side view showing a coupled state of connection links of FIG. 5.

The front tray 170, as shown in FIGS. 5 and 7, may include a lower plate 171*a*, both side surfaces 171*b* disposed perpendicular to both sides of the lower plate 171*a*, and a front surface 171*c* and a rear plate 171*d* disposed perpendicular to front and rear of the lower plate 171*a*, respectively. Here, the side plates 171*b*, the front plate 171*c* and the rear plate 171*d* of the front tray 170 may have the same height.

A handle 173 may be disposed at a front area (portion) of the front tray 170. The handle 173 may facilitate gripping for moving the front tray 170 and the rear tray 150 in back and forth directions.

For example, the handle 173 of the front tray 170 may be formed at the front area of the lower plate 171*a* by upwardly recessing the corresponding front area.

Both sides of the rear tray 150 and the front tray 170 may be shown having rails 180 for supporting the rear tray 150 and the front tray 170 to be slidable back and forth, so as to allow the rear tray 150 and the front tray 170 to be smoothly slidable back and forth.

Each of the rails 180 may include a fixed rail 182 fixed onto an inner wall of the freezing chamber 121 (the cooling chamber 120), and a movable rail 184 retractably coupled to the fixed rail 182. Here, the number of movable rails 184 may be appropriately adjusted.

The rear tray 150 and the front tray 170 may be relatively slidable with respect to the movable rails 184.

A stopping jaw 185 which contacts the rear tray 150 upon backward sliding of the rear tray 150 may be disposed at a rear end of the movable rail 184. Hence, the movable rail 184 may be pressed back upon the backward sliding of the rear tray 150, so as to be slid back together with the rear tray 150.

In the meantime, both sides of the rear tray 150 and the front tray 170 may be shown having link receiving portions 210 each for receiving a partial area of the connection links 249.

For example, each link receiving portion 210 may include a rear link receiving portion 211 for receiving the rear area of the connection links 249 therein, and a front link receiving portion 231 for receiving the front area of the connection links 249 therein.

The rear link receiving portion 211 may be disposed at both sides of the rear tray 150.

Each of the rear link receiving portions 211, for example, may include an inner support plate 212 attached onto the side plate 151*b* of the rear tray 150, and an outer support plate 222 for forming an inner receiving space in cooperation with the inner support plate 212.

Upper and lower end areas of the rear tray 150 may be shown having protruding portions 157 which are externally protruding.

The rear link receiving portion 211 may be coupled to the protruding portions 157 in a contact state.

Each rear link receiving portion 211 may include rotational shafts 224 to which rear end portions of the rear link 250 and the front link 260 are rotatably coupled, respectively.

For example, the rotational shafts 224 may be formed at one of the inner support plate 212 or the outer support plate 222, and coupling portions 216 for coupling of the rotational shafts 224 thereto may be formed at the other. Here, the coupling portion 224 may be formed such that an end portion of the corresponding rotational shaft 224 can be inserted by a predetermined depth. This exemplary embodiment illustrates that one side of the rotational shaft 224 has a reduced diameter in a radial direction, and the coupling portion 216 is configured for the reduced area of the rotational shaft 224 to be inserted therein.

A recessed portion 214 may be formed at at least one of the inner support plate 212 and the outer support plate 222 of the rear link receiving portion 211. The recessed portion 214 may be recessed in a thickness direction of the plate to correspond to upper and lower rotation tracks of the front link 260 and the rear link 250.

This exemplary embodiment illustrates that the rotational shafts 224 are disposed at the outer support plate 222, and the recessed portion 214 and the coupling portions 216 for insertion of the rotational shafts 224 therein are formed at the inner support plate 212.

In the meantime, both sides of the front tray 170 may be shown having front link receiving portions 231 for receiving front areas of the connection links 249 (the rear link 250 and the front link 260).

Bent portions which are bent inward may be formed at rear areas of both the side plates 171*b* of the front tray 170, respectively.

The front link receiving portion 231 may be disposed in each the bent portions 175.

Each of the front link receiving portions 231 may include an inner support plate 232 disposed on the curved portion 175 of the front tray 170, and an outer support plate 242 disposed at outside of the inner support plate 232 to form a receiving space in cooperation with the inner support plate 232.

Each front link receiving portion 231 may have a length corresponding to about a half of a length of the side plate 171*b* of the front tray 170.

A recessed portion 236 may be formed at at least one of the inner support plate 232 and the outer support plate 242 of the front link receiving portion 231. The recessed portion 236 may be recessed in a thickness direction of the plate to correspond to rotation tracks of the front link 260 and the rear link 250.

Rotational shafts 244, to which front end portions of the rear link 250 and the front link 260 are rotatably coupled, respectively, may be formed at the front link receiving portion 231. For example, the rotational shafts 244 may be formed at one of the inner support plate or the outer support plate 242 and coupling portions 238 for insertion of the rotational shafts 244 therein may be formed at the other.

This exemplary embodiment illustrates that the recessed portion 236 and the coupling portions 238 are formed at the inner support plate 232 and the rotational shafts 244 are disposed at the outer support plate 242. Here, the coupling portion 238 may be formed such that an end portion of the rotational shaft 244 can be inserted by a predetermined depth. This exemplary embodiment illustrates that one side of the rotational shaft 244 has a reduced diameter in a radial direction and the coupling portion 238 is formed for the reduced area of the rotational shaft 244 to be inserted therein.

Figure 9:
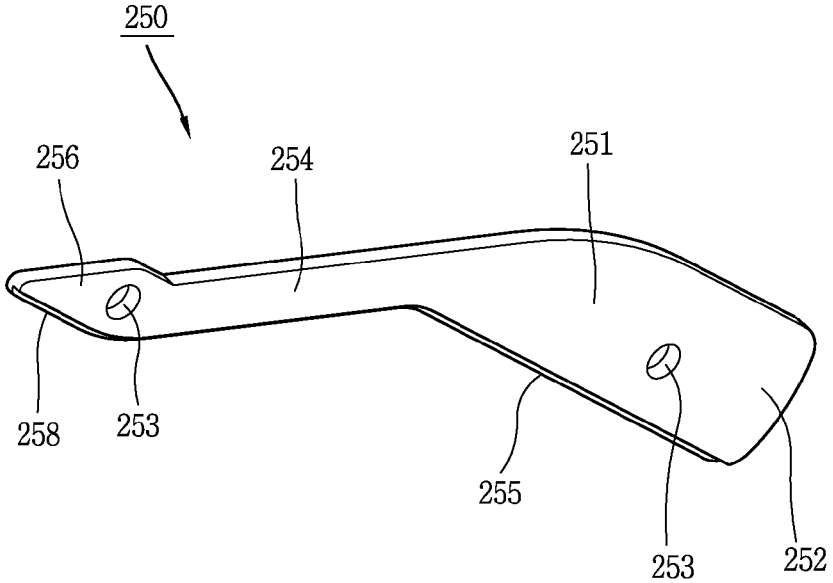
FIG. 9 is a perspective view of a rear link shown in FIG. 5.

The rear link 250, for example, as shown in FIG. 9, may include an inclined section 251 extending from a connection end 252 of the rear tray 150 to be upwardly inclined, and a horizontal section 254 horizontally extending from the inclined section 251 toward a connection end 256 of the front tray 170. Shaft holes 253 for insertion of the rotational shafts 244 therein may be formed through the inclined section 251 and the horizontal section 254, respectively.

Figure 10:
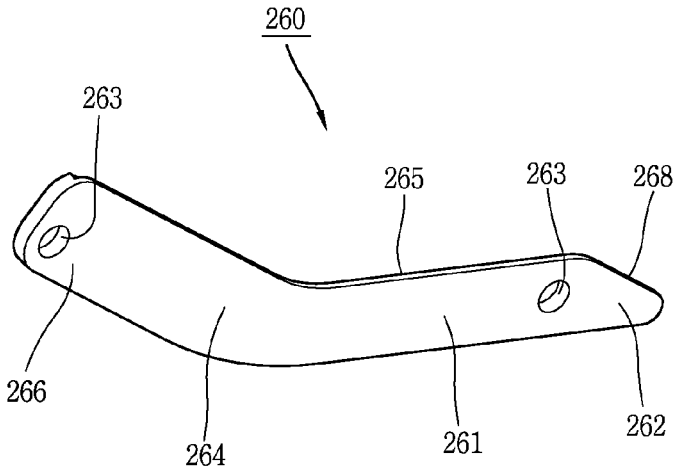
FIG. 10 is a perspective view of a front link shown in FIG. 5.

For example, the front link 260, as shown in FIG. 10, may include a horizontal section 261 extending from a connection end 262 of the rear tray 150 toward the front tray 170, and an inclined section 264 extending from the horizontal section 261 toward a connection end 266 of the front tray 170 in an inclined state. Shaft holes 263 for insertion of the rotational shafts 244 may be formed through the horizontal section 261 and the inclined section 264.

During a downward movement of the front tray 170, the rear link 250 and the front link 260 may contact each other, supporting the front tray 170.

In more detail, contact surfaces 255 and 265 may be formed on a lower end of the rear link 250 and an upper end of the front link 260. The contact surfaces 255 and 265 may be engaged with each other. For example, one side of the rear link 250 may be cut off into a step-like shape in a thickness direction, and the other end of the front link 260 may be cut off into a step-like shape in a thickness direction, so as to be engaged with each other in a contact state.

A downwardly inclined portion 268, which is cut off to correspond to the inclined section 251 of the rear link 250, may be formed at a rear end portion of the front link 260. That is, the downwardly inclined portion 268 may be downwardly inclined from the horizontal section 261 of the front link 260 in a backward direction.

Also, an upwardly inclined portion 258, which is upwardly inclined from the horizontal section 254 of the rear link 250 to be contactable with the inclined section 264 of the front link 260.

Each movable rail 184 may include a roller 190 which is contactable with the front link 260.

The roller 190 may include a first roller 191 and a second roller 192 which are spaced apart from each other in a back-and-forth direction.

The first roller 191 which is disposed at a front end of the movable rail 184 may contact the horizontal section 261 of the front link 260 upon descending the front tray 170, guiding the descending of the front link 260. This may allow for smooth descending of the front tray 170.

With the configuration, when desiring to put foods in or take foods out of the front tray 170 or the rear tray 150, the front tray 170 may be pulled forward by gripping the handle 173 of the front tray 170.

As the front tray 170 is pulled forward, the movable rail 284 may be slid forward with respect to the fixed rail 182. Accordingly, the front tray 170 and the rear tray 150 may be drawn out.

The movable rail 184 may be stopped after being slid to the front side of the fixed rail 182 by a predetermined length.

When the movable rail 184 is stopped, the front tray 170 and the rear tray 150 may be relatively moved with respect to the movable rail 184, thereby being moved forward.

When the rear tray 150 is moved forward, the horizontal section 261 of the front link 260 may be moved with being supported by the roller 190 in a contact state.

When the rear end portion of the front tray 170 is moved over the first roller 191, the front tray 170 may be descended by its own weight. That is, the front link 260 and the rear link 250 may be rotated down based on the rotational shafts 224 and 244 disposed at the rear end portions thereof, respectively. Here, the front tray 170 and the rear tray 150 may be slid forward along the movable rail 184 and simultaneously the front link 260 and the rear link 250 may be rotated down.

Figure 11:
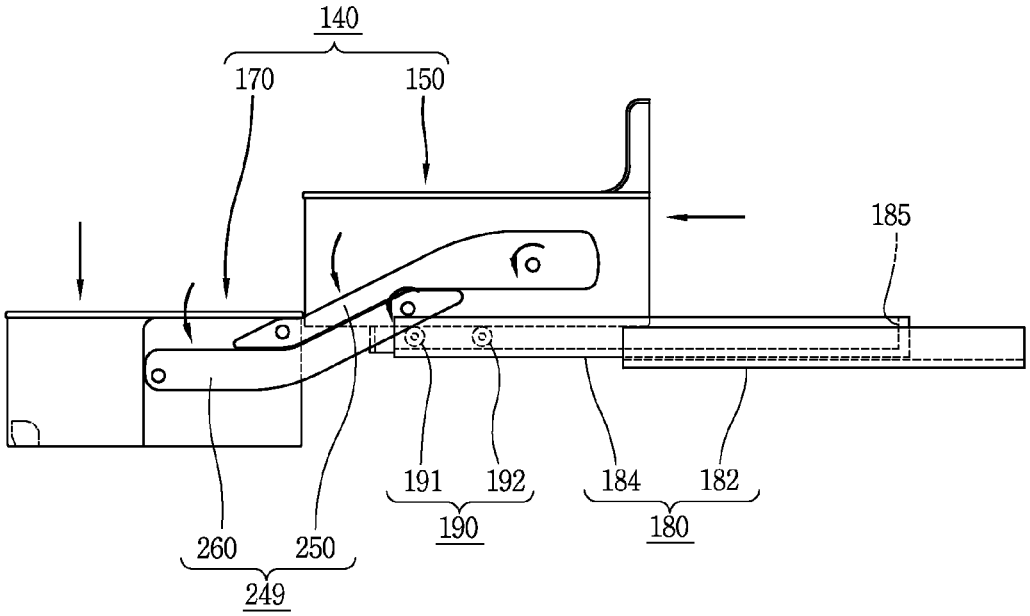
FIG. 11 is a view showing a descended state of the front tray shown in FIG. 8.

When the front tray 170 is drawn out, the upper contact surface 265 of the front link 260 and the lower contact surface 255 of the rear link 250 may contact each other. With the contact surfaces 255 and 265 contacting each other, the rear link 250 and the front link 260 are locked by each other, and accordingly, as shown in FIG. 11, the front tray 170 may be held at the descended position. This may allow foods to be put in and/or taken out of the front tray 170 and the rear tray 150. Especially, the upper opening of the rear tray 150 may be sufficiently open, resulting in facilitating viewing of the inside of the tray and stacking and taking out foods.

Meanwhile, upon desiring to move the front tray 170 back into the retraction position, a front portion of the front tray 170 may be pushed back.

When the front tray 170 is pushed back, the front link 260, which is downwardly inclined in a forward direction, may be rotated up as its lower surface is rolled on the first roller 191. Accordingly, the rear tray 150 may be moved back, and the front tray 170 may be ascended as the front link 260 and the rear link 250 are rotated up.

When the rear tray 150 and the front tray are moved back by a predetermined distance, the front tray 170 may be moved up so as to be slid on the movable rail 184.

When the rear tray 150 is slid back along the movable rail 184, it may contact the stopping jaw 185. Accordingly, the rear tray 150 and the front tray 170 may be relatively slid back with respect to the fixed rail 182 as well as the movable rail 184, thereby being back into the initial retraction (receiving) position.

Hereinafter, description will be given of another exemplary embodiment with reference to FIGS. 12 to 21.

Figure 12:
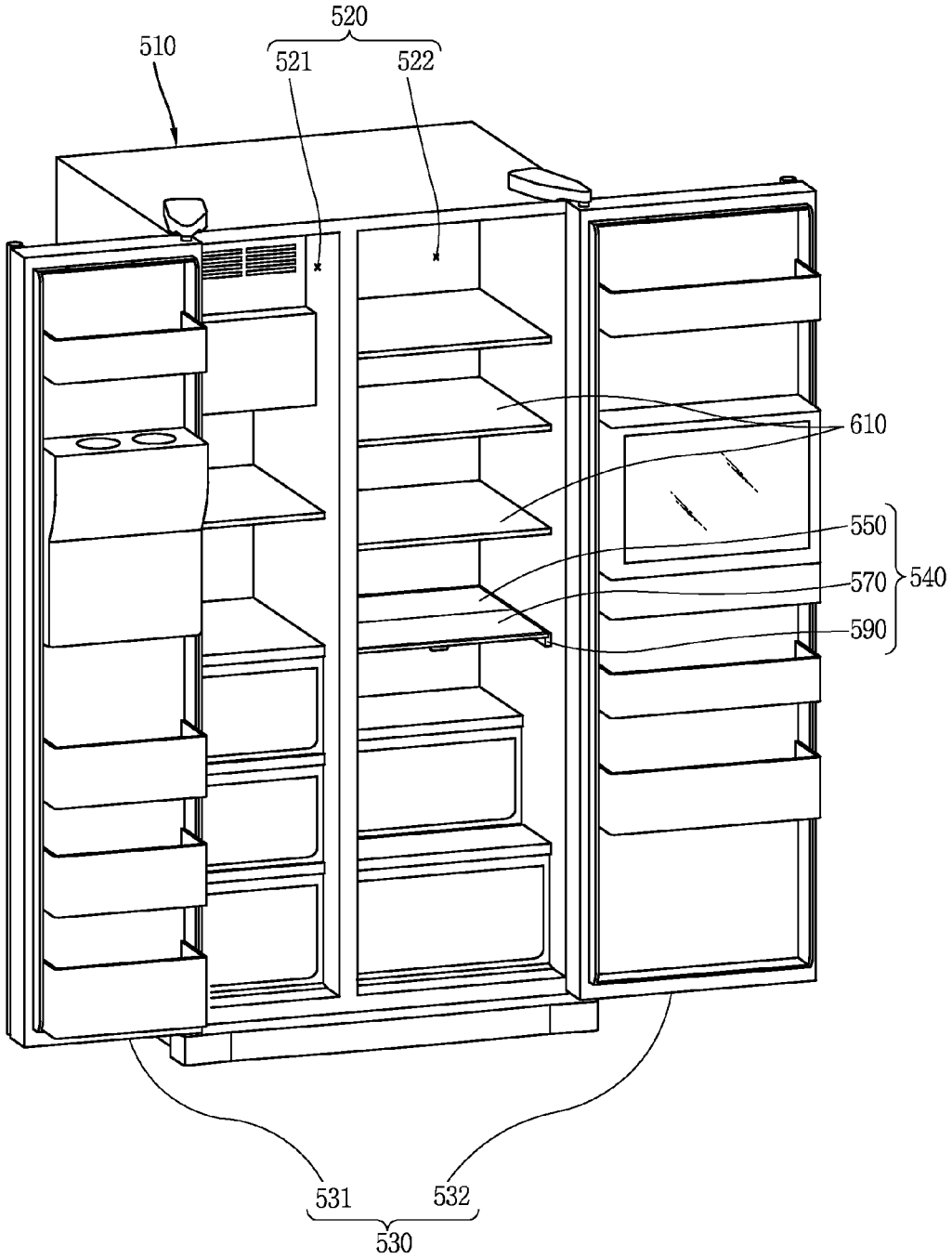
FIG. 12 is a perspective view of a refrigerator in accordance with another exemplary embodiment.

Referring to FIG. 12, a refrigerator according to another exemplary embodiment may include a refrigerant main body 510 having a cooling chamber 520, a cooling chamber door 530 for opening and closing the cooling chamber 520, a rear storage member disposed at a rear area of the cooling chamber 520 to be drawn out in back and forth directions of the cooling chamber 120, and a front storage member disposed at the front of the rear storage member to be relatively movable with respect to the rear storage member. Here, the cooling chamber 520 may include both a freezing chamber 521 and a refrigerating chamber 522, and the refrigerator main body 510 may include one of the freezing chamber 522 or the refrigerating chamber 522. Also, although not shown in detail, a rear tray and a front tray aforementioned with reference to FIGS. 3 to 11 may be disposed within the cooling chamber 520. The rear storage member and the front storage member may be configured as a rear shelf 550 and a front shelf 570 for storing goods and/or foods thereon.

A plurality of cooling chambers 520 may be disposed inside the refrigerator main body 510.

The cooling chamber 520 may include the freezing chamber 521 and the refrigerating chamber 522.

The cooling chamber door 530 for opening and closing the cooling chamber 520 may be installed at the refrigerator main body 510.

The cooling chamber door 530 may include a freezing chamber door 531 for opening and closing the freezing chamber 521 and a refrigerating chamber door 532 for opening and closing the refrigerating chamber 522.

A plurality of shelves 540 may be disposed in the cooling chamber 520.

The shelves 540 may be disposed with being spaced apart in a longitudinal direction. Here, the shelves 540 may be disposed in the freezing chamber 521 and the refrigerating chamber 522, respectively, and the configurations in both chambers are similar to each other. Hereinafter, shelves 540 disposed in the refrigerating chamber 522 will be exemplarily described.

Figure 13:
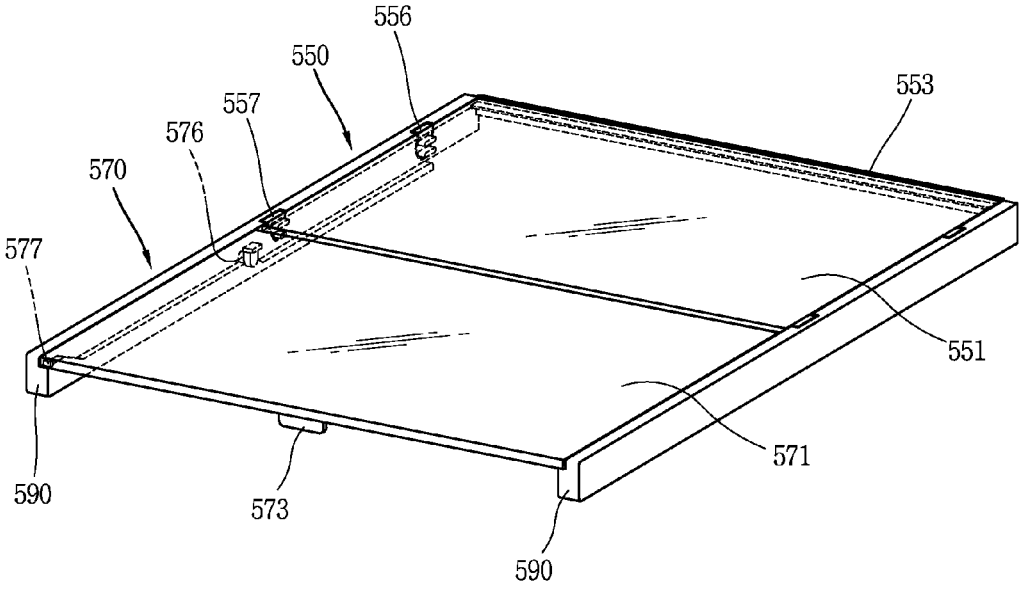
FIG. 13 is a perspective view showing a coupled state of a rear shelf and a front shelf shown in FIG. 12.
Figure 14:
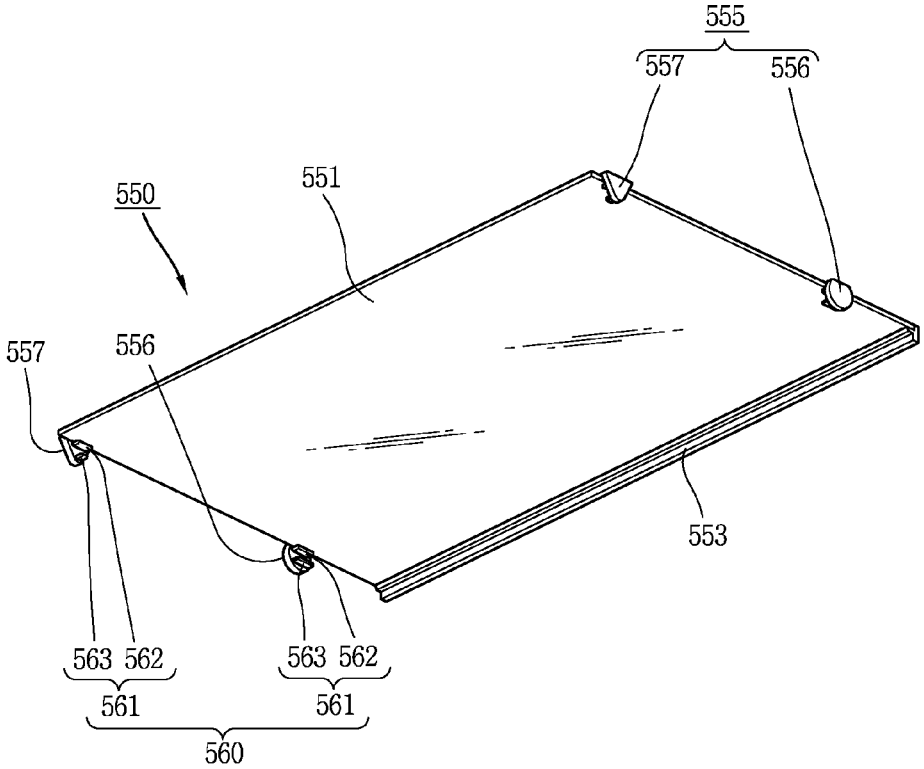
FIG. 14 is a perspective view of the rear shelf shown in FIG. 13.
Figure 15:
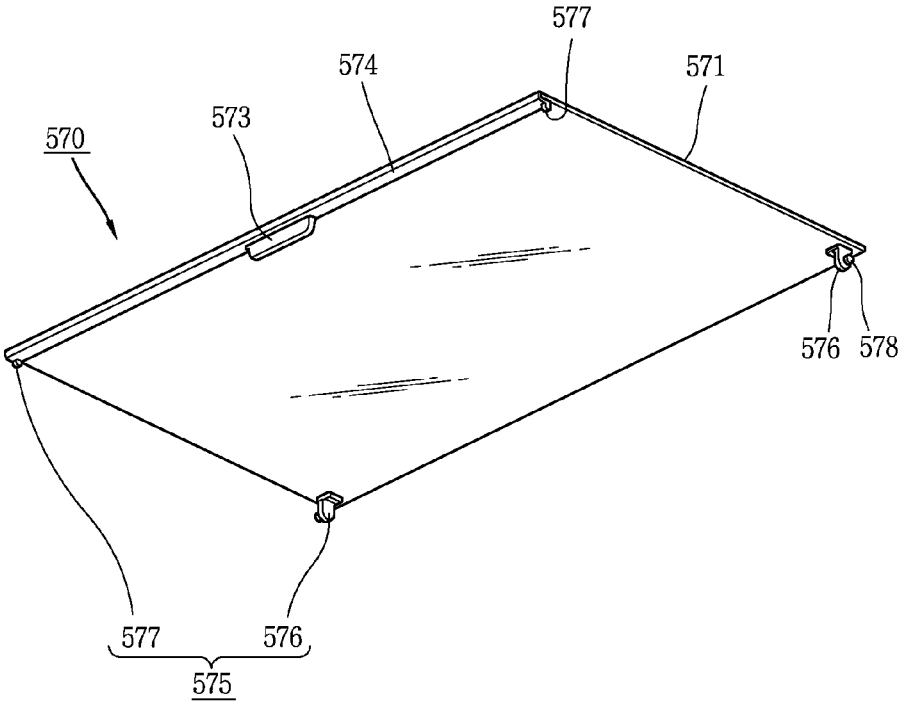
FIG. 15 is a perspective view of the front shelf shown in FIG. 13.

Each of the shelves 540, as shown in FIG. 13, may include a rear shelf 550 disposed at a rear area of the cooling chamber 520 (for example, in the refrigerating chamber 522), and a front shelf 570 movable between a support position where it is disposed at a front area of the rear shelf 550 and a retraction position where it is disposed below the rear shelf 550.

Supporting members 590 for supporting the rear shelf 550 and the front shelf 570 may be disposed at both sides of the rear shelf 550 and the front shelf 570, respectively.

The rear shelf 550, for example, may include a rear shelf body 551 formed in a shape of an approximately rectangular plate, and a plurality of protrusions 555 disposed on a lower surface of the rear shelf body 551.

The rear shelf body 551 may have a length corresponding to a width of the refrigerating chamber 522 in a horizontal direction, and a back-and-forth width corresponding to approximately a half of the back-and-forth width of the refrigerating chamber 522 (the cooling chamber 520). Here, the rear shelf body 551 may be made of a rigid material (for example, tempered glass).

A front shelf supporting portion 553 may protrude from a rear end area of the rear shelf body 551 in a thickness direction to support the front shelf 570. Accordingly, when the front shelf 570 is located at the retraction position, a rear end of the front shelf 570 may be supported by the front shelf supporting portion 553 in a contact state.

The front shelf supporting portion 553 may be separately made from the rear shelf body 551, to be coupled to the rear shelf body 551. For example, the front shelf supporting portion 553 may be made of a metal or synthetic resin.

The protrusions 555 may include rear protrusions 556 located at the rear area of the rear shelf body 551, and front protrusions 557 located at a front area of the rear shelf body 551. Here, the protrusions 555 may be made of synthetic resin (for example, ABS resin), being coupled to protrude from a lower surface of the rear shelf body 551.

The front protrusions 557, for example, may be disposed at a front area of both side portions of the rear shelf body 551. Each front protrusion 557 may protrude to a lower side of the rear shelf body 551. The front protrusions 557 may be coupled to externally protrude from the both side portions of the rear shelf body 551. The front protrusion 557 may be configured such that its width can gradually decrease in the protruding direction. The front protrusion 557 may be formed similar to a triangular shape.

The rear protrusions 556, for example, may be disposed at a rear area of both side portions of the rear shelf body 551. The rear protrusion 556 may protrude from a lower side of the rear shelf body 551. The rear protrusion 556 may be coupled to externally protrude from both side portions of the rear shelf body 551. The rear protrusion 556 may have an approximately arcuate shape. Here, the rear protrusion 556 may have a disk shape having a predetermined diameter, and be cut based on an upper surface of the rear shelf body 551.

Front shelf inserting portions 560 for insertion of the front shelf 570 therein may be disposed inside the front protrusion 557 and the rear protrusion 556, respectively. The front shelf inserting portions 560 may include a pair of ribs 561 which protrude from inner surfaces of the front protrusion 557 and the rear protrusion 556, respectively, in series to each other. Each rib 561, for example, may include an upper rib 562 disposed at an upper side and a lower rib 563 disposed at a lower side in a longitudinal direction.

The front shelf 570 may include a front shelf body 571 having a shape of an approximately rectangular plate, and protrusions 575 disposed on a lower surface of the front shelf body 571.

The front shelf body 571 may have a length corresponding to a length corresponding to a horizontal width of the refrigerating chamber 522, and a back-and-forth width corresponding to approximately a half of the back-and-forth width of the refrigerating chamber 522 (cooling chamber 520). Here, the rear shelf body 551 may be made of a rigid material (for example, tempered glass).

A handle 573 may be disposed at a front area of the front shelf body 571, facilitating back and forth sliding of the front shelf 570 when pulling out and/or pushing in the front shelf 570.

The handle 573 may be separately formed from the front shelf body 571 to be coupled to the front shelf body 571. For example, the handle 573 may include a coupling portion 574 coupled to a front side portion of the front shelf body 571. The handle 573 may downwardly protrude from a lower surface of a central area of the coupling portion 574.

The protrusions 575 may include rear protrusions 576 disposed at both sides of the rear area of the front shelf body 571, and front protrusions 577 disposed at both sides of the front areas of the front shelf body 571.

The protrusions 577 may downwardly protrude from a lower surface of both sides of the coupling portion 574 of the handle 573. A lower portion of each front protrusion 577, for example, may be formed in an arcuate shape. Here, the front protrusions 577 may be separately formed from the handle 573, being coupled to the lower surface of the front shelf body 571.

The rear protrusions 576, for example, may be made of synthetic resin (for example, ABS resin) and coupled to the front shelf body 571.

The rear protrusions 576 may be coupled to the front shelf body 571 at positions inwardly moved by a predetermined distance from both sides of the front shelf body 571.

The rear protrusions 576, for example, may downwardly protrude more than the front protrusions 577.

A support pin 578 may protrude from one side (an outer side) of each rear protrusion 576 to be horizontal to the protruding direction of the rear protrusion 576.

Both sides of each of the front shelf 570 and the rear shelf 550 may be shown having support members 590 for supporting the front shelf 570 and the rear shelf 550.

The support members 590 may be disposed at both side walls of the refrigerating chamber 522 (or the cooling chamber 520). For example, the support members 590 may be made of synthetic resin and coupled to the side walls of the refrigerating chamber 522.

Figure 16:
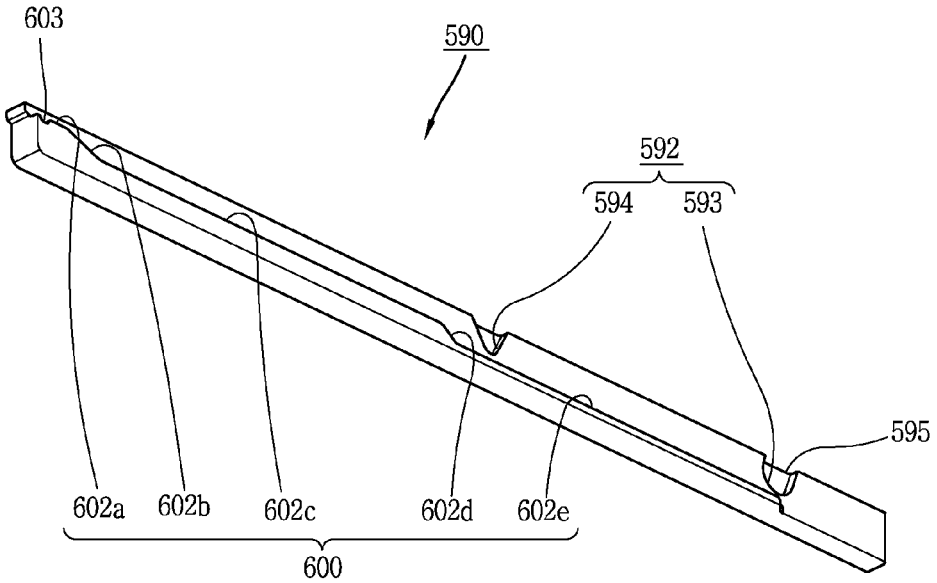
FIG. 16 is a perspective view of a support holder shown in FIG. 13.

Each support member 590, as shown in FIG. 16, may have a length corresponding to a back-and-forth width of the refrigerating chamber 522 (or the cooling chamber 520).

Each support member 590 may include a rear shelf supporting portion 592 for supporting the rear shelf 550.

The rear shelf supporting portion 592 may include a rear protrusion receiving portion 593 and a front protrusion receiving portion 594 for receiving the rear protrusion 556 and the front protrusion 557, respectively.

The front protrusion receiving portion 594 may be recessed into an approximately triangular shape in a thickness direction.

The rear protrusion receiving portion 593 may be formed in a circular shape to receive the rear protrusion 556 therein. An inlet 595 may be formed by cutting off an upper side of the rear protrusion receiving portion 593 by a width corresponding to a diameter of the rear protrusion 556. Accordingly, the rear protrusion 556 may be inserted into the rear protrusion receiving portion 593 via the inlet 595.

Each support member 590 may include a guide portion 600 for guiding the front shelf 570 to a lower side of the rear shelf 550.

The guide portion 600 may inwardly protrude from an inner surface of each support member 590.

The guide portion 600 may be formed in back and forth directions with a height difference.

The guide portion 600, for example, may include a first horizontal section **602*a* located at the frontmost in back and forth directions and having a relatively the highest height, a first inclined section 602*b* downwardly inclined from the rear of the first horizontal section 602*a*, a second horizontal section 602*c* horizontally extending from the first inclined section 602*b* to the rear side, a second inclined section 602*d* downwardly inclined from the second horizontal section 602*c* to the rear side, and a third horizontal section 602*e* horizontally extending from the second inclined section 602*d* to the rear side. Here, the third horizontal section 602*e*, for example, may extend down to the rear protrusion receiving portion 593 of the rear shelf 550. Accordingly, upon upward rotation of the rear shelf 550 and the front shelf 570, interference between the third horizontal section 602*e* and the rear shelf 550 and the front shelf 570** may be avoided.

A stopping jaw 603, at which the front protrusion 577 is stopped when the front shelf 570 is stopped at the support position, may be formed at the first horizontal section **602*a***.

The stopping jaw 603 may be downwardly recessed into an upper surface of the guide portion 600 (or the first horizontal section 602*a*) by a predetermined depth.

The stopping jaw 603 may be recessed into an approximately arcuate shape (or a semi-circular shape). Accordingly, the front shelf 570 may be prevented from being suddenly moved in the back and forth directions. The configuration may allow the front shelf 570 to be relatively stably supported at the support position.

In the meantime, the refrigerator may include a single plate-like shelf 610 (hereinafter, shelf 610) disposed above or below the rear shelf 550 and the front shelf 570.

Figure 19:
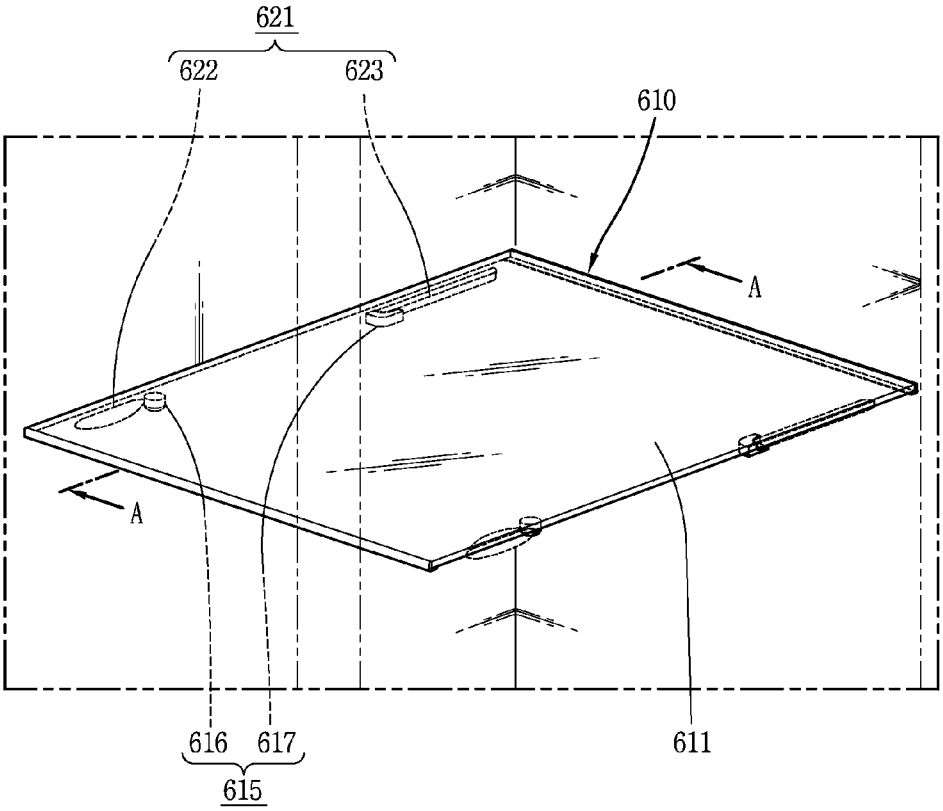
FIG. 19 is a perspective view of the shelf shown in FIG. 12.

The shelf 610, for example, as shown in FIG. 19, may have a shape of an approximately rectangular plate having a length corresponding to a horizontal width of the refrigerating chamber 522 (or the cooling chamber 520), and a width corresponding to the back-and-forth width of the refrigerating chamber 522.

The shelf 610 may include a shelf body 611 made of a rigid member. The shelf body 611 may be made of tempered glass, for example.

The shelf 610 may include a corrosion-processed portion 612*a* formed by corroding one surface thereof. This may induce diffused reflection of light emitted from a lighting device, preventing dazzling. In this exemplary embodiment, the corrosion-processed portion 612*a* may be formed on a lower surface of the shelf 610.

A plurality of protrusions 615 may be formed on the lower surface of the shelf body 611.

The protrusion 615 may be made of synthetic resin, for example, ABS resin.

The protrusions 615 may include a front protrusion 616 disposed at the front of the shelf 610 in a back-and-forth direction of the refrigerating chamber 522, and a rear protrusion 617 disposed at the rear of the shelf 610.

Support protrusions 621 for supporting the shelf 610 may be disposed on an inner wall of the refrigerating chamber 522 (or the cooling chamber 520).

The support protrusions 621 may include a front support protrusion 622 disposed at a front area of the refrigerating chamber 522 (or the cooling chamber 520), and a rear support protrusion 623 disposed at a rear area of the front support protrusion 622 with a spaced distance therefrom.

Figure 20:
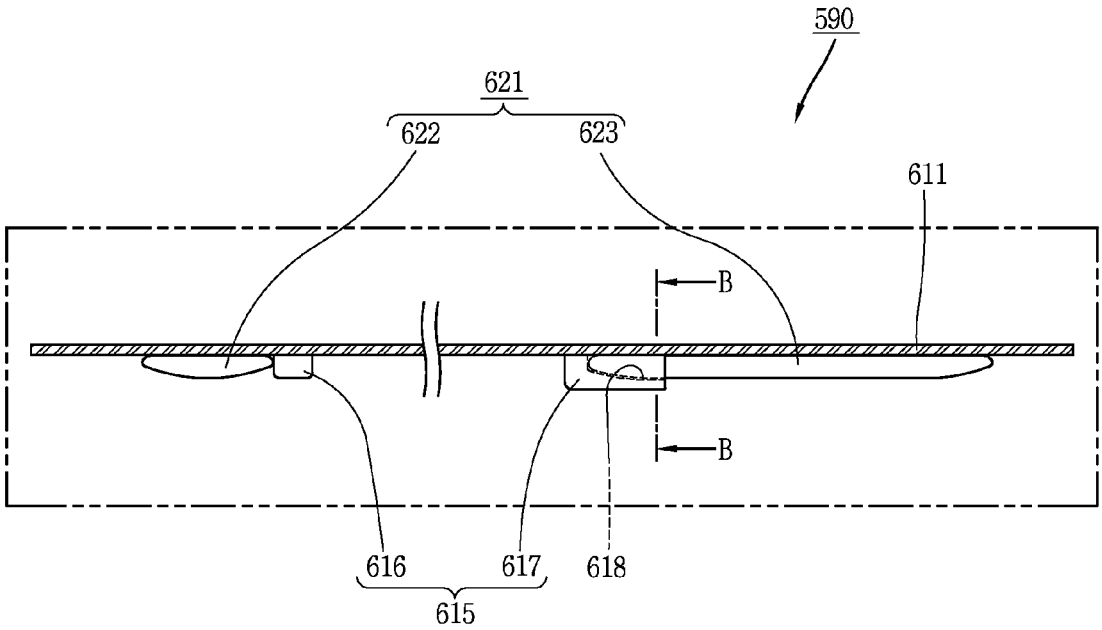
FIG. 20 is a sectional view taken along the line A-A of FIG. 19.
Figure 21:
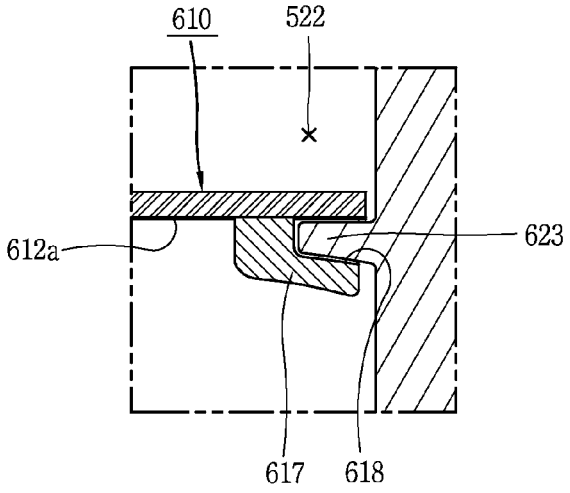
FIG. 21 is a sectional view taken along the line B-B of FIG. 20.

The front support protrusion 622, for example, as shown in FIG. 20, may be disposed at the front of the front protrusion 616.

The rear support protrusion 623 may be disposed at the front of the rear protrusion 617.

The rear protrusion 617, for example, as shown in FIG. 20, may include an insertion portion 618 for insertion of a front end portion of the rear support protrusion 623 therein.

With the configuration, the front shelf 570 may be disposed at the front of the rear shelf 550 when it is located at the support position, so as to be flush with the rear shelf 550, forming a support surface in cooperation with the rear shelf 550 to store foods thereon.

Meanwhile, for storing relatively long food stuffs below the front shelf 570, the front shelf 570 may be pushed back. Here, the front portion of the front shelf 570 may be slightly lifted up prior to pushing the front shelf 570 back to separate the front protrusions 577 from the stopping jaws 603, and thereafter the front shelf 570 may be pushed back.

When the front shelf 570 is pushed back, each support pin 578 of the front protrusion 577 and the rear protrusion 576 of the front shelf 570 may be moved back along the guide portion 600.

When the front shelf 570 starts to be moved back to the retraction position, each rear protrusion 576 of the front shelf 570 may be lowered in height along the second inclined section 602*d*. Here, the rear side portion of the front shelf 570 may be inserted down to the front side portion of the rear shelf 550.

Both side portions of the front shelf 570 may be moved back with being inserted into the front shelf inserting portion 560 of the rear shelf 550. After being moved back, both the side portions of the front shelf 570 may be supported by the front shelf inserting portion 560 and the rear side portion thereof may be supported by the front shelf supporting portion 553.

Figure 17:
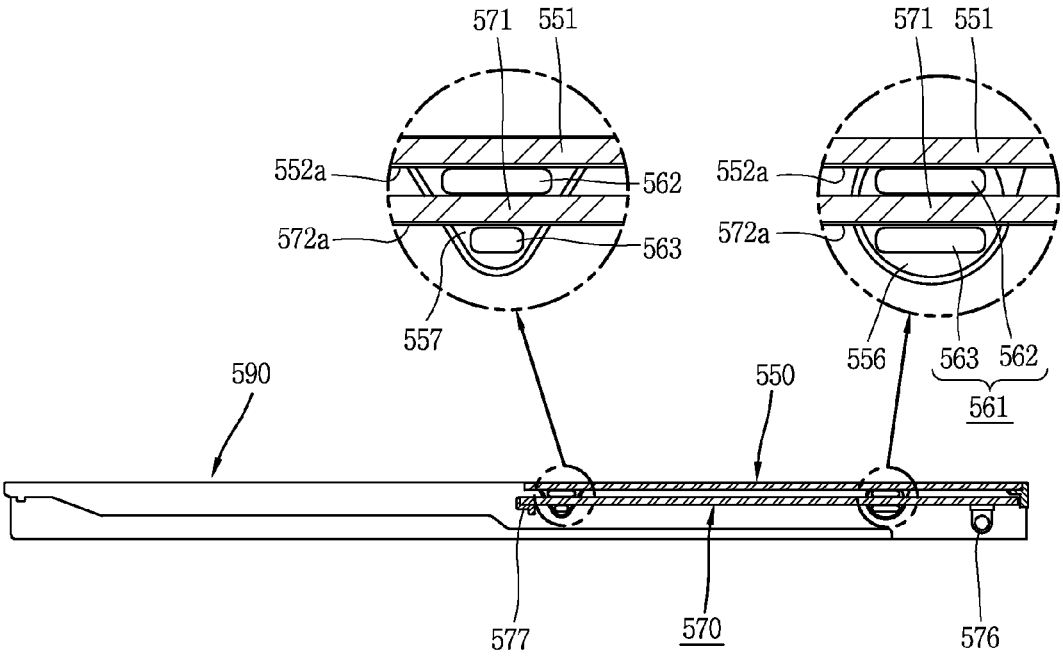
FIG. 17 is a side sectional view at a retraction position of the front shelf shown in FIG. 13.

When the front shelf 570 is moved back to the retraction position, as shown in FIG. 17, the front area of the rear shelf 550 may extend in a vertical direction. This may allow relatively long food stuffs (for example, bottles) to be stored on the shelf 610 below the front shelf 570 or the front shelf 570.

For storing relatively long food stuffs on the shelf 610 below the front shelf 570 and the rear shelf 550 or on the front shelf 570 and the rear shelf 550, the front shelf 570 may first be moved back to the retraction position below the rear shelf 550.

As shown in FIG. 17, the front shelf 570 and the rear shelf 550 which overlap each other may be rotated up by pushing them up.

When the overlapped front shelf 570 and rear shelf 550 are pushed up, the front shelf 570 and the rear shelf 550 may be rotated up based on the rear protrusions 556 of the rear shelf 550. Here, the front shelf 570 and the rear shelf 550 may be disposed approximately perpendicular to the lower shelf 610.

Figure 18:
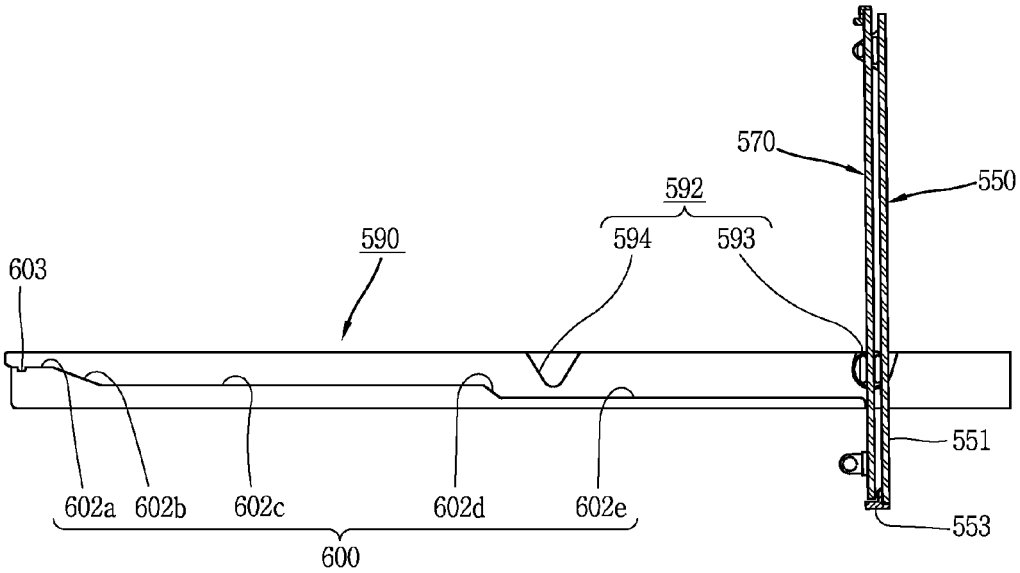
FIG. 18 is a view showing a rotated state of the rear shelf and the front shelf shown in FIG. 17.

When the front shelf 570 and the rear shelf 550 are rotated up, as shown in FIG. 18, the areas of the front and rear shelves 570 and 550 may extend in a vertical direction. This may facilitate relatively long food stuffs to be stored on the lower shelf 610 or the front and rear shelves 570 and 550.

Meanwhile, when the relatively long food stuffs are drawn out, the upwardly rotated front and rear shelves 570 and 550 may be rotated down, and thereafter the front shelf 570 may be pulled out to the support position.

Hereinafter, description will be given of another exemplary embodiment with reference to FIGS. 22 to 29.

Figure 22:
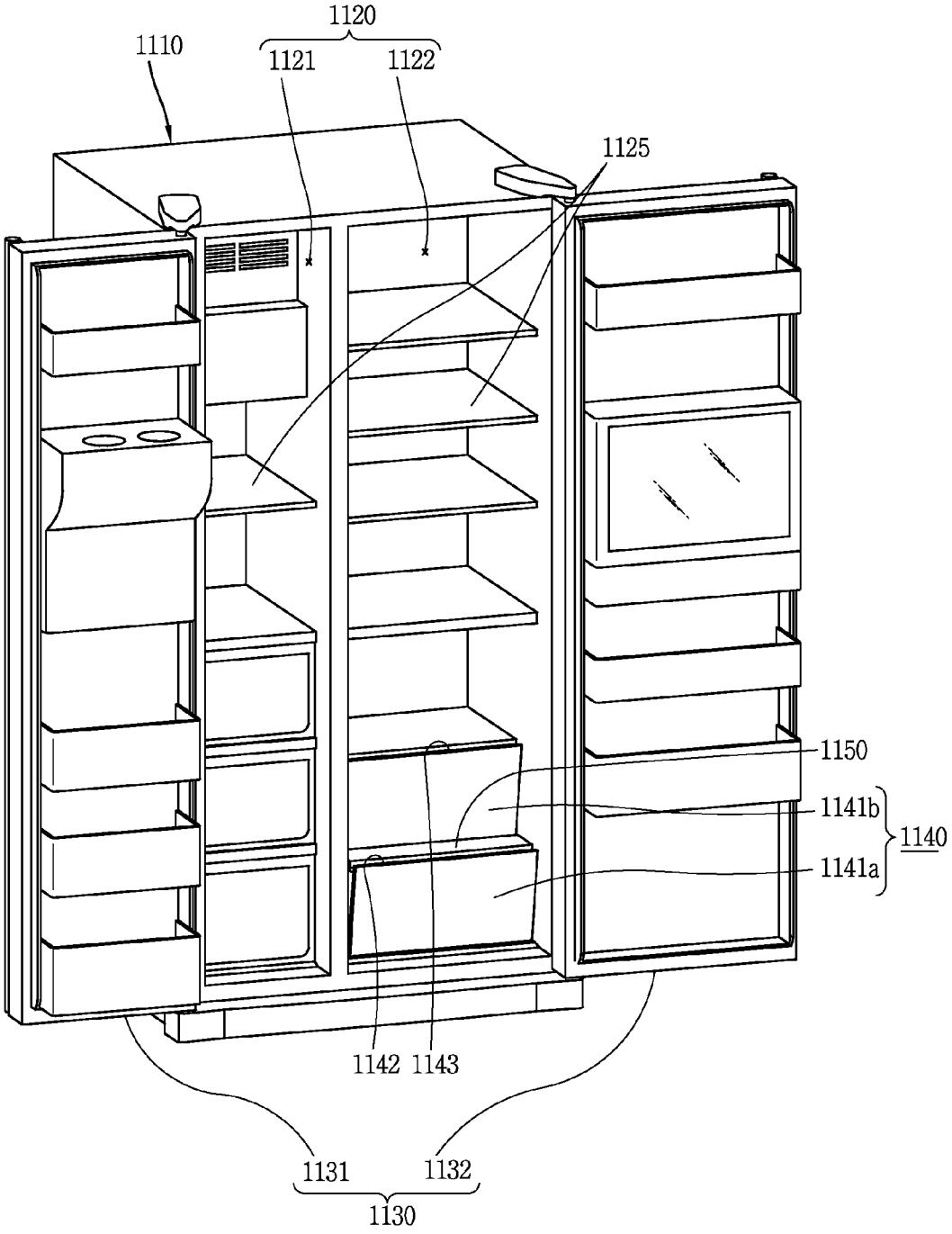
FIG. 22 is a view of a refrigerator in accordance with one exemplary embodiment.
Figure 23:
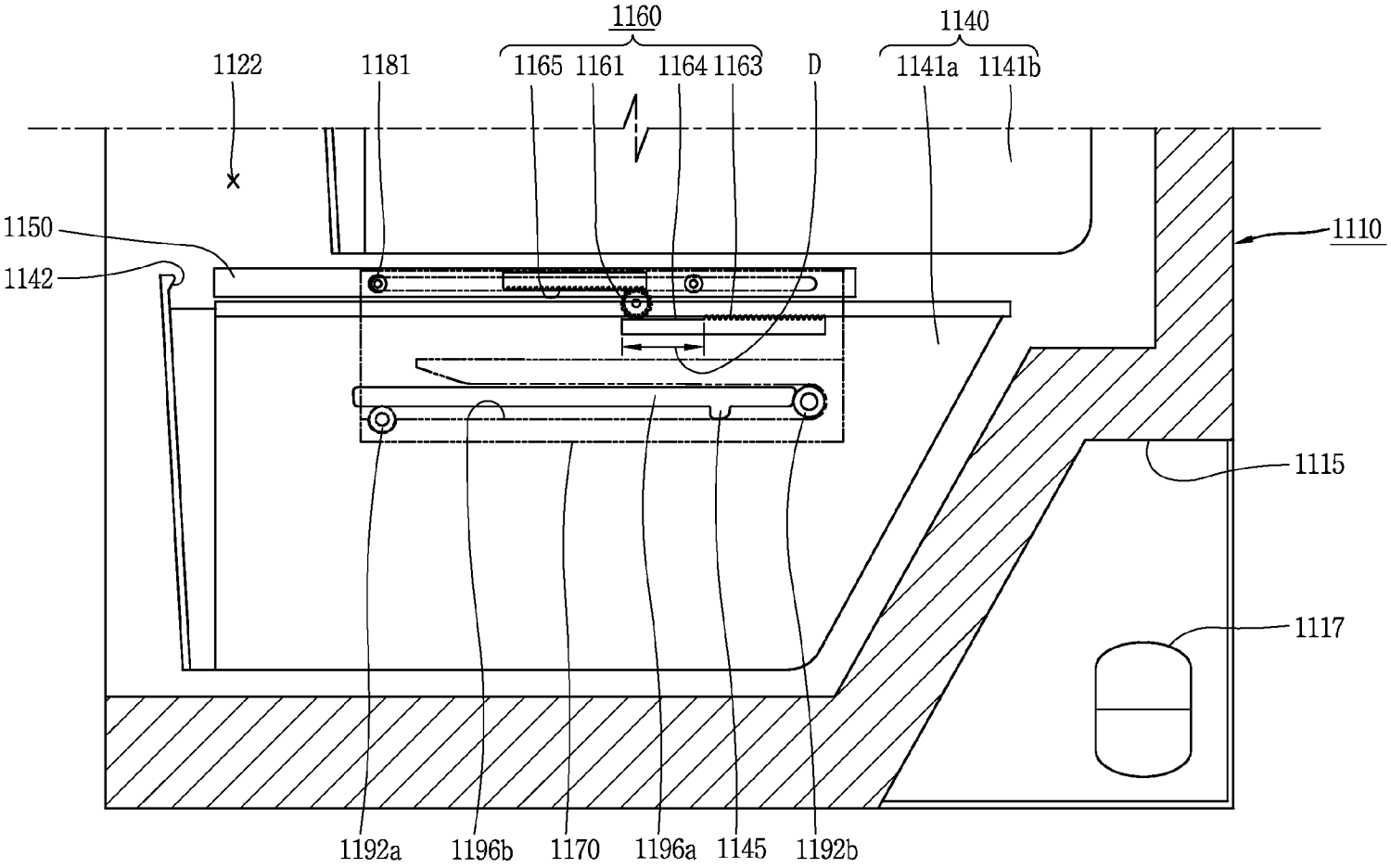
FIG. 23 is a sectional view showing a drawer area of FIG. 22.
Figure 24:
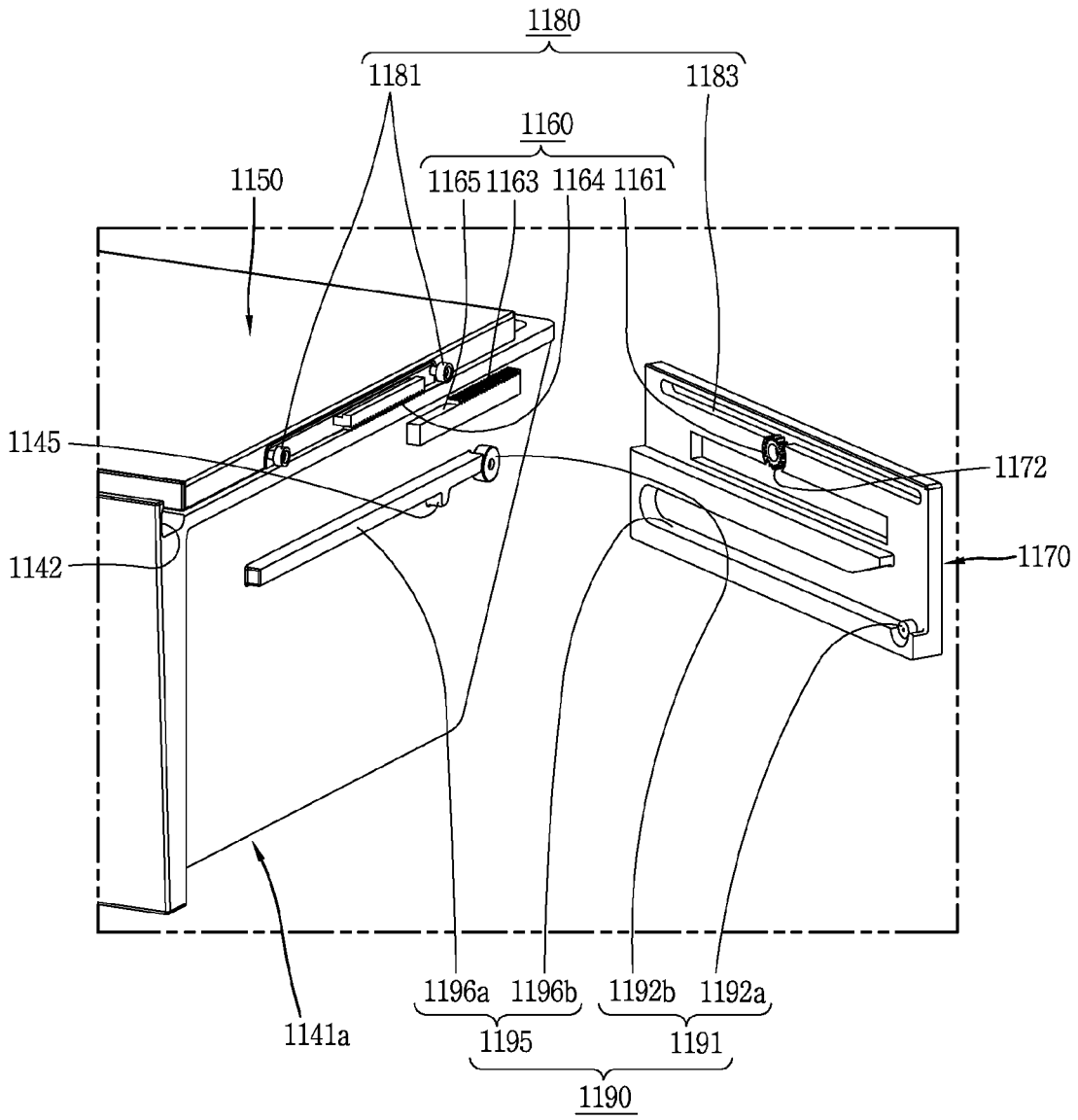
FIG. 24 is a disassembled perspective view of a drawer and a holder shown in FIG. 23.

As shown in FIGS. 22 and 23, a refrigerator according to another exemplary embodiment may include a refrigerator main body 1110 having a cooling chamber 1120, a drawer 1140 disposed in the cooling chamber 1120, a cover 1150 disposed on the drawer 1140, and a cover driving unit 1160 for backward sliding of the cover 1150 when the drawer 1140 is pulled out. Here, the cooling chamber 1120 may be referred to as both freezing chamber 1121 and refrigerating chamber 1122. The refrigerator main body 1110 may include at least one of the freezing chamber 1121 and the refrigerating chamber 1122. Although not shown in detail, the rear tray and the front tray illustrated with reference to FIGS. 3 to 11 and/or the rear shelf and the front shelf illustrated with reference to FIGS. 12 to 21 may be disposed within the cooling chamber 1120. Those components will be understood by the foregoing description.

A plurality of cooling chambers 1120 may be disposed within the refrigerator main body 1110.

The cooling chamber 1120 may include a freezing chamber 1121 and a refrigerating chamber 1122.

The freezing chamber 1121 and the refrigerating chamber 1122 may be partitioned from each other side by side.

A cooling chamber door 1130 for opening and closing the cooling chamber 1120 may be installed at the refrigerator main body 1110.

The cooling chamber door 1130 may include a freezing chamber door 1131 and a refrigerator chamber door 1132 for opening and closing the freezing chamber 1121 and the refrigerating chamber 1122, respectively.

The refrigerator main body 1110 may include a refrigeration cycle system for providing cold air to the cooling chamber 1120. The refrigeration cycle system may be implemented as a vapor compression type refrigeration cycle system for generating cold air through processes of compression, condensation, expansion and evaporation of a refrigerant.

The refrigerator main body 1110 may include a machine room 1115 for installation of part of the refrigeration cycle system (for example, compressor 1117) therein.

The machine room 1115 may occupy a rear lower area of the refrigerator main body 1110.

A plurality of shelves 1125 may be disposed within the refrigerating chamber 1122, to partition an inner space of the refrigerating chamber 1122 into upper and lower spaces. Each shelf 1125 may store food stuffs in a sorting manner. This may allow for efficient use of the inner space of the refrigerating chamber 1122.

A drawer 1140 may be disposed at a lower area of the refrigerating chamber 1122.

The drawer 1140 may be provided in plurality.

The drawers 1140 may be located vertically with a spaced distance.

The drawer 1140 may include a lower drawer 1141*a* and an upper drawer 1141*b*.

The upper drawer 1141*b* may have a shape similar to a rectangular case with an upper opening.

A handle 1143 may be disposed at a front surface of the upper drawer 1141*b*.

The lower drawer 1141*a* may forwardly protrude rather than the upper drawer 1141*b*, increasing an inner storage space thereof.

The lower drawer 1141*a* may have a shape of a box with an upper opening.

The lower drawer 1141*a* may be formed such that a rear end portion is inclined upwardly.

A handle 1142 may be disposed at a front area (front portion) of the lower drawer 1141*a*, facilitating the lower drawer 1141*a* to be drawn out and/or retracted. This exemplary embodiment illustrates that the handle 1142 is formed at an upper end of the front area, but the handle 1142 may be formed at a central portion of the front area.

The cover 1150 may be disposed on the lower drawer 1141*a*.

The cover 1150, for example, may have a shape of a rectangular plate.

The cover 1150 may shield the upper opening of the lower drawer 1141*a*.

The cover 1150 may have a size smaller than a size of the upper opening of the lower drawer 1141*a* such that cold air can be introduced into the lower drawer 1141*a*. For example, the cover 1150 may have a size the same as or similar to a lower surface of the lower drawer 1141*a*.

A cover driving unit 1160 may be disposed at one side of the cover 1150 to allow the cover 1150 to be slidable backward upon pulling the drawer 1140 (lower drawer 1141*a*) out. This may allow the cover 1150 to be slid back upon pulling the drawer 1140 (lower drawer 1141*a*) out, extending the upper opening of the drawer 1140 (lower drawer 1141*a*).

In more detail, the cover 1150 may be slid to a lower side of the upper drawer 1141*b*. That is, a front end portion of the cover 1150 may be disposed on the same line with a lower end portion of the upper drawer 1141*b* or rather disposed at the rear of the upper drawer 1141*b*. Accordingly, an interference with the cover 1150 may rarely occur upon putting food stuffs in the drawer 1140 (or the lower drawer 1141*a*) or taking such food stuffs out. Also, this may allow the upper drawer 1141*b* to be drawn forward in a state that the lower drawer 1141*a* has been drawn forward. Any interference (contact) between the cover 1150 and the upper drawer 1141*b* may not occur upon pulling the upper drawer 1141*b* out, settling concerns about damage on the cover 1150 and/or the upper drawer 1141*b*.

The cover driving unit 1160, for example, may include a pinion 1161, a first rack 1163 disposed on the drawer 1140 (or the lower drawer 1141*a*) and engaged with the pinion 1161, and a second rack 1165 disposed on the cover 1150 and engaged with the pinion 1161.

The pinion 1161 may be disposed on both side walls (left and right side walls) of the refrigerating chamber 1122.

Both sides of the cover 1150 may be shown having the second racks 1165 engaged with the pinions 1161, respectively.

The pinion 1161 may be engaged with one end portion of each second rack 1165 in a lengthwise direction. This may allow the cover 1150 to be relatively slidable in response to rotation of the pinion 1161.

The first racks 1163 may be disposed at both sides of the drawer 1140 (or the lower drawer 1141*a*).

The first rack 1163 may be disposed at the rear of each pinion 1161 by a predetermined spaced distance D in back and forth directions of the refrigerating chamber 1122. Accordingly, after the lower drawer 1141*a* is spaced by the spaced distance D, the pinion 1161 may be engaged with the first rack 1163 to perform relative motion. Here, the spaced distance D may be adjusted in an appropriate manner.

A non-tooth section 1164 without being engaged with the pinion 1161 may be formed at one side of the first rack 1163. The non-tooth section 1164 may have the same length as the space distance D.

In the meantime, both sides of the cover 1150 may be shown having cover supporting units 1180 for supporting the cover 1150 to be slidable back and forth.

Each of the cover supporting units 1180 may include cover support rollers 1181, and a cover support rail 1183 on which the cover support roller 1181 rolls to perform relative motion therewith.

The cover support rollers 1181 may be disposed on the cover 1150.

The cover support rollers 1181 may be disposed at front and rear areas of each of both sides of the cover 1150.

The cover support rail 1183 may be disposed at each of both side walls (or left and right side walls) of the refrigerating chamber 1122.

For example, the cover support rail 1183 may be formed at a holder 1170.

The holder 1170 may have a shape similar to a rectangular plate.

The cover support rail 1183 may be formed at an upper area of the holder 1170 such that the cover support roller 1181 can be slid back and forth with being inserted therein.

The cover support rail 1183 may be recessed into an inner surface of the holder 170 in a thickness direction, and extend back and forth.

The holder 1170 may be provided with a pinion receiving portion 1172 for rotatably receiving the pinion 1161.

The pinion receiving portion 1172 may have upper and lower openings. Accordingly, upper and lower areas of the pinion 1161 may be exposed so as to be engaged and rotated with the second rack 1165 and the first rack 1163.

Drawer supporting units 1190 may be disposed at both sides of the drawer 1140 to allow the drawer 1140 to be slidable back and forth.

Each of the drawer supporting units 1190 may include a drawer support roller 1191, and a drawer support rail 1195 for guiding the drawer support roller 1191.

The drawer support roller 1191 may be provided in plurality.

At least one of the drawer support rollers 1191 may be disposed in the cooling chamber 1120.

Each drawer support roller 1191 may include a first drawer support roller 1192*a* disposed on a side wall of the refrigerating chamber 1122.

In more detail, the first drawer support roller 1192*a* may be disposed on the holder 1170.

The drawer support rail 1195 may be provided in plurality.

The drawer support rail 1195 may include a first drawer support rail 1196*a* formed on the lower drawer 1141*a* to perform a relative motion with contacting the first drawer roller 1192*a*. One side of the first drawer support rail 1196*a* may be shown having a stopper 1145 which contacts the first drawer support roller 1192*a* to prevent the lower drawer 1141*a* from being drawn out. The stopper 1145 may downwardly protrude from the first drawer support rail 1196*a*. The stopper 1145 may be formed on a rear end portion of the first drawer support rail 1196*a*.

The drawer support roller 1191 may include a second drawer support roller 1192*b* disposed on a side wall of the lower drawer 1141*a*.

The drawer support rail 1195 may include a second drawer support rail 1196*b* which performs a relative motion with contacting the second drawer support roller 1192*b*. The second drawer support rail 1196*b* may be disposed on a side wall of the refrigerating chamber 1122. In more detail, the second drawer support rail 1196*b* may be disposed on the holder 1170. The second drawer support rail 1196*b* may be implemented as a slit recessed in a thickness direction of the holder 11870 and extending back and forth.

With the configuration, in a state that the lower drawer 1141*a* is retracted in the refrigerating chamber 1122, as shown in FIG. 23, the non-tooth section 1164 may be disposed below the pinion 1161.

In this state, when the handle 1142 of the lower drawer 1141*a* is pulled out to forwardly draw the lower drawer 1141*a* out, the lower drawer 1141*a* may be slid forward with being supported by the drawer supporting unit 1190.

Once the lower drawer 1141*a* is slid forward, the pinion 1161 may remain stopped as long as the non-tooth section 1164.

Figure 25:
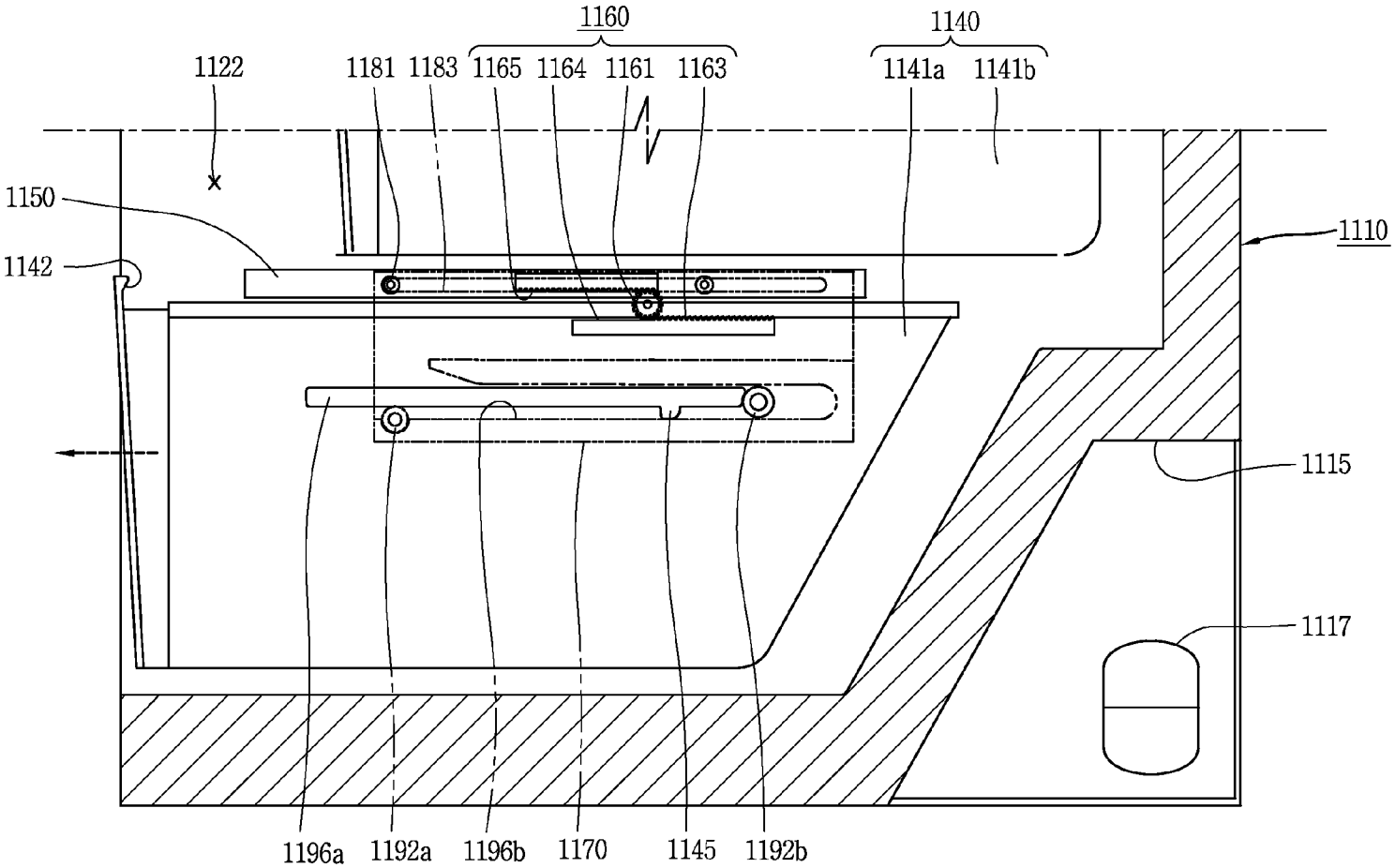
FIGS. 25 and 26 are views showing a process of pulling the drawer out.

When the lower drawer 1141*a* is slid forward by the spaced distance D, as shown in FIG. 25, the pinion 1161 and the first rack 1163 may be engaged with each other.

Figure 26:
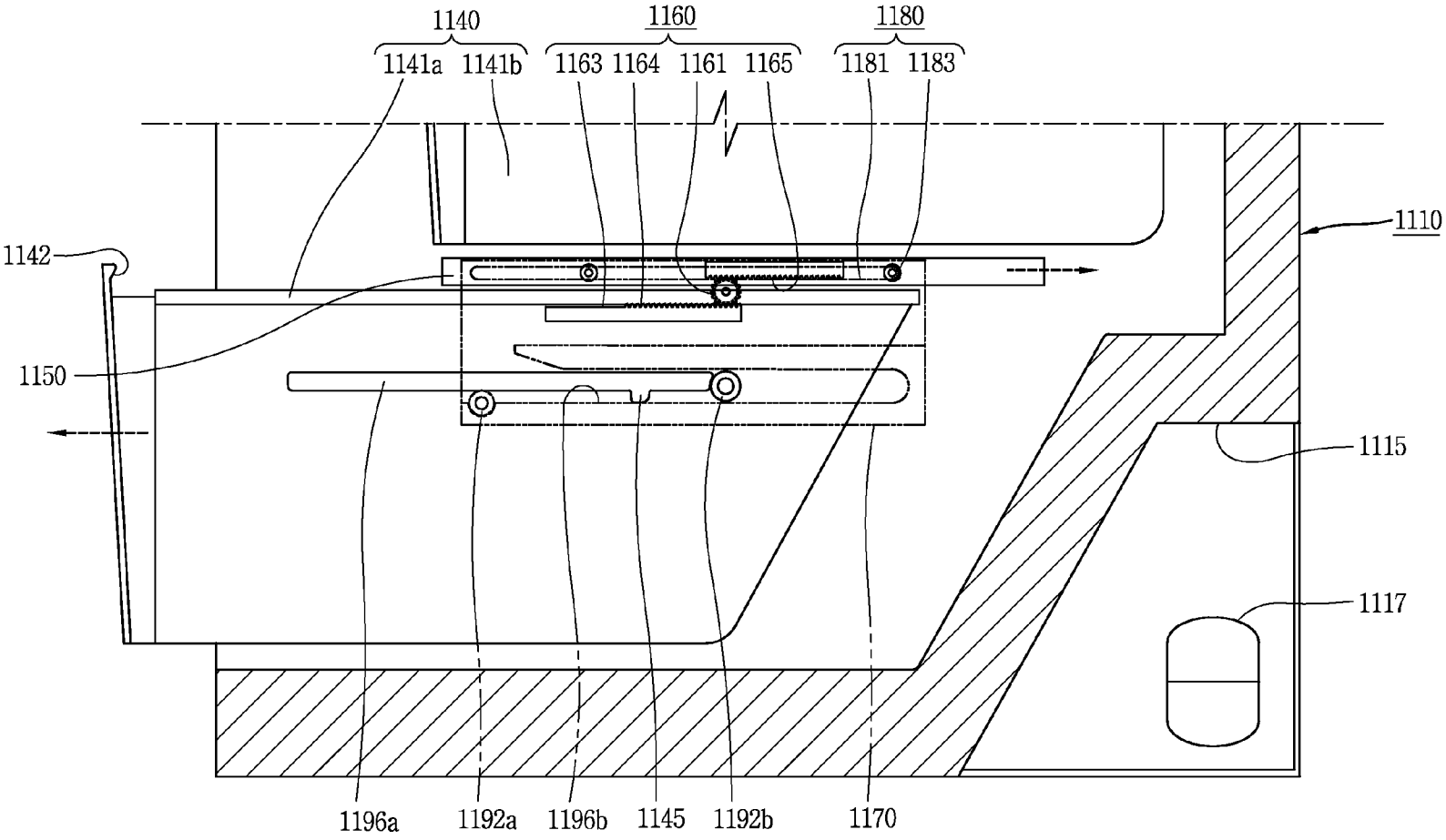

When the first rack 1163 is moved forward in response to sliding of the lower drawer 1141*a*, the pinion 1161 may be rotated. Once the pinion 1161 starts to be rotated, as shown in FIG. 26, the second rack 1165 may be pressed by the pinion 1161 to be moved back. Accordingly, the cover 1150 may be slid back with being supported by the cover supporting units 1180. Here, the cover 1150 may be located on the same line with the front end of the lower portion of the upper drawer 1141*b* or rather disposed at the rear of the upper drawer 1141*b*. Consequently, the upper opening of the lower drawer 1141*a* may be fast open.

In the meantime, for retracting the lower drawer 1141*a* into the refrigerating chamber 1122, the front portion (or the handle 1142) of the lower drawer 1141*a* may be pushed back.

The lower drawer 1141*a* may be slid back with being supported by the drawer support units 1190, to be back into the initial retraction position.

When the lower drawer 1141*a* starts to be moved back, the pinion 1161 may be rotated by the second rack 1165 and simultaneously the first rack 1163 is moved forward, making the cover 1150 slid forward. Afterward, when the lower drawer 1141*a* is continuously slid such that the non-tooth section 1164 is slid over the pinion 1161, the pinion 1161 may be stopped.

Hereinafter, description will be given of another exemplary embodiment with reference to FIGS. 27 to 29.

The same and equivalent components to the foregoing configurations will not be shown in the drawings for the sake of explanation and be provided with reference to the same reference numerals. Also, duplicate description for those components will be omitted.

A refrigerator according to another exemplary embodiment may include a refrigerator main body 1110 having a cooling chamber 1120, a drawer 1140 disposed in the cooling chamber 1120, a cover 1150 disposed on the drawer 1140, and a cover driving unit 1210 for allowing the cover 1150 to be slid back upon drawing the drawer 1140 out.

The drawer 1140 may be provided in plurality.

The drawer 1140 may include an upper drawer 1141*b* and a lower drawer 1141*a*.

The cover 1150 may be disposed on the lower drawer 1141*a*.

Both sides of the cover 1150 may be shown having cover driving units 1210 for allowing the cover 1150 to be slid back upon drawing the drawer 1140 (or the lower drawer 1141*a*) out.

The cover driving units 1210 may be disposed at both sides of the cover 1150.

Figure 27:
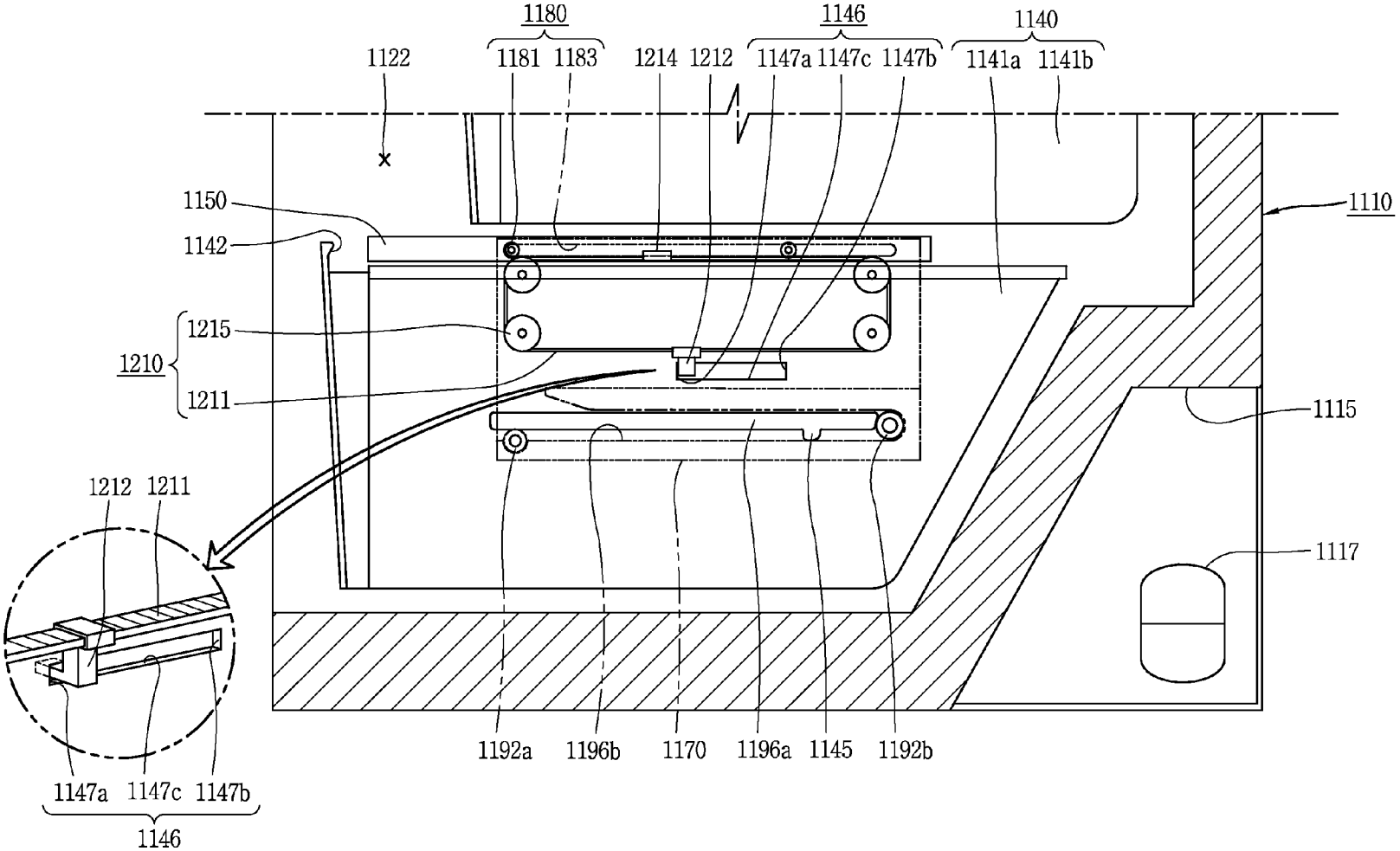
FIG. 27 is a view of a cover driving unit in accordance with another exemplary embodiment.

For example, each cover driving unit 1210, as shown in FIG. 27, may include a belt 1211 connected to the cover 1150 and the lower drawer 1141*a*, respectively, and a plurality of pulleys for movably supporting the belt 1211.

The belt 1211 may be movably disposed on a side of the cover 1150 and the lower drawer 1141*a* with a predetermined length.

The plurality of pulleys 1215 for movably supporting the belt 121 may be disposed in the belt 1211. For example, a pair of pulleys 1215 which are spaced from each other in a vertical direction may be disposed at each of the front and rear sides. Here, the belt 1211 may be able to perform forward and reverse rotation.

One area of the belt 1211 may be shown having a power transfer piece 1212 protruding toward the lower drawer 1141*a*.

A power transfer piece receiving portion 1146 for insertion of the power transfer piece 1212 therein may be disposed at a side wall portion of the lower drawer 1141*a*.

The power transfer piece receiving portion 1146, for example, may be formed by recessing a side surface of the lower drawer 1141*a* and extending back and forth.

The power transfer piece receiving portion 1146 may include a non-contact section 1147*c* at which power is not transferred to the belt 1211 during sliding of the lower drawer 1141*a*. A length of the non-contact section 1147*c* may be appropriately adjusted, taking into account a sliding distance of the lower drawer 1141*a* and the cover 1150.

In more detail, the power transfer piece receiving portion 1146 may be implemented as a long slit with a preset length formed in a back-and-forth sliding direction of the lower drawer 1141*a*. The long slit may include the non-contact section 1147*c*.

That is, when the power transfer piece 1212 contacts a front end portion 1147*a* and a rear end portion 1147*b* of the power transfer piece receiving portion 1146 by being inserted into the power transfer piece receiving portion 1146, the belt 1211 may be pressed by a driving force, which is generated in response to sliding of the lower drawer 1141*a*, performing forward rotation or reverse rotation.

Between the front end portion 1147*a* and the rear end portion 1147*b* of the power transfer piece receiving portion 1146, namely, within the non-contact section 1147*c*, the belt 1211 may remain stopped without rotation even if the lower drawer 1141*a* is moved.

Another area of the belt 1211 may be shown having a connection piece 1214 for connecting the belt 1211 to the cover 1150. One side of the connection piece 1214 may be coupled to the belt 1211 and the other side may be coupled to the cover 1150. Accordingly, the cover 1150 may simultaneously be moved in response to the rotation of the belt 1211.

Both sides of the cover 1150 may be shown having cover supporting units 1180 for supporting the cover 1150 to be slidable back and forth.

Both sides of the lower drawer 1141*a* may be shown having drawer supporting units 1190 for supporting the lower drawer 1141*a* to be slidable back and forth.

Both side walls of the refrigerating chamber 1122 may be shown having holders 1170. Here, the detailed configurations of the cover supporting unit 1180 and the drawer supporting unit 1190 are similar to or the same as the foregoing description, so they will not be explained again.

With the configuration, in the state that the lower drawer 1141*a* is located within the refrigerating chamber 1122, as shown in FIG. 27, the power transfer piece 1212 may contact the front end portion 1147*a* of the power transfer receiving portion 1146.

In this state, when the lower drawer 1141*a* is pulled out, the lower drawer 1141*a* may be slid forward with being supported by the drawer supporting units 1190.

Here, the belt 1211 may be suspended while the power transfer piece 1212 is slid over the non-contact section 1147*c*. Accordingly, the cover 1150 may be suspended while the lower drawer 1141*a* is slid as long as the non-contact section 1147*c*.

Figure 28:
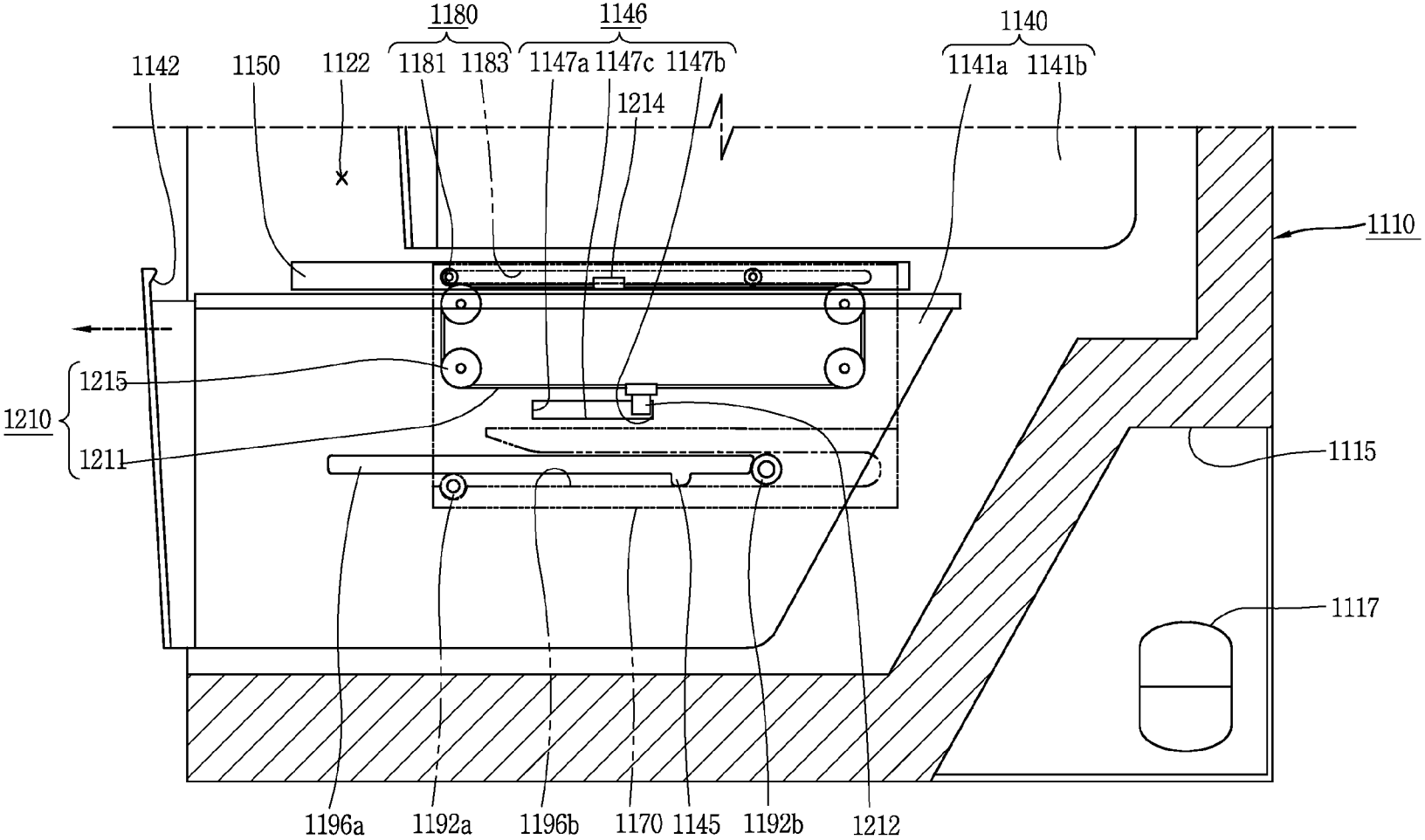
FIGS. 28 and 29 are views each showing the process of pulling out the drawer shown in FIG. 27.

When the lower drawer 1141*a* is continuously slid forward, as shown in FIG. 28, the power transfer piece 1212 may contact the rear end portion 1147*a* of the power transfer piece receiving portion 1146.

Under this state, when lower drawer 1141*a* is further slid forward, the power transfer piece 1212 may be pressed forward by the rear end portion 1147*b*, rotating (traveling) the belt 1211.

Figure 29:
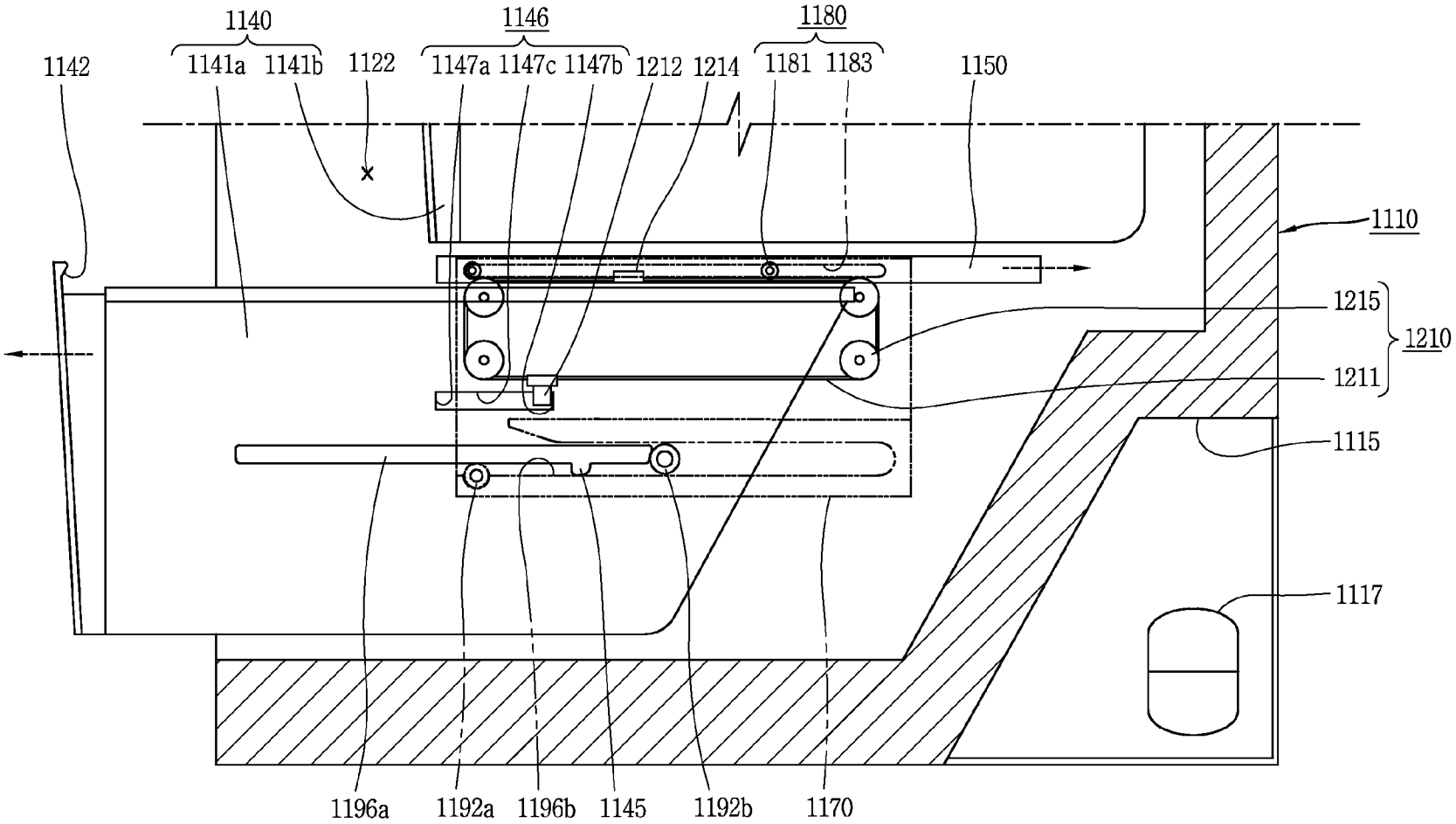

The cover 1150, as shown in FIG. 29, may be slidable to a lower side of the upper drawer 1141*b*. Accordingly, upon opening the upper drawer 1141*b*, the upper drawer 1141*b* and the cover 1150 may be free from interference therebetween.

In the meantime, when the lower drawer 1141*a* is pushed back, the lower drawer 1141*a* may be slid back into the refrigerating chamber 1122, in an opposite manner of pulling it out.

Here, the belt 1211 may remain stopped during the non-tooth section 1147*c* at the beginning of sliding of the lower drawer 1141*a*.

When the lower drawer 1141*a* is continuously slid back, the power transfer piece may contact the front end portion 1147*a* of the power transfer piece receiving portion 1146. Accordingly, the power transfer piece 1212 may be pushed back, rotating the belt 1211.

As soon as the belt 1211 being rotated, the cover 1150 may be slidable forward. The lower drawer 1141*a* may be slid back and the cover 1150 may be moved forward, thereby fast blocking the upper opening of the lower drawer 1141*a*.

The foregoing embodiments illustrate the cover driving unit is disposed at both sides of the cover, but another embodiment may be implemented such that the cover driving unit is disposed at one of both sides of the cover.

As described above, in accordance with one exemplary embodiment, a front tray and a rear tray may be disposed in back and forth directions of a cooling chamber and the front tray may be connected to the rear tray via a connection link so as to be moved up and down, facilitating food stuffs to be stored in and taken out of the tray (i.e., the rear tray).

Also, the tray may be fully drawn forward to improve usage of a rear space (i.e., the rear tray). Especially, this may facilitate food stuffs to be stored in the rear tray in a stacking manner.

Employment of a rear shelf and a retractable front shelf located below the rear shelf may facilitate food stuffs to be put on and drawn out. Especially, this may facilitate storing and drawing for relatively long food stuffs.

The rear shelf and the front shelf may be perpendicularly rotatable in an overlapped state, facilitating long food stuffs to be put on or drawn out. Especially, after drawing out the long food stuffs, the front shelf and the rear shelf may be easily moved back to their initial positions, acquiring convenience in use.

In addition, as a corrosion-processed portion may be disposed on one surface of the rear shelf or the front shelf, diffused reflection of light emitted from a lighting device may be generated, preventing dazzling by the shelves.

As a cover is slidable backward upon drawing a drawer out, an upper opening of the drawer may extend, facilitating food stuffs to be stored in or drawn out of the drawer.

Also, as the cover is slidable backward upon drawing a drawer out, interference between an upper drawer and the cover may be avoided upon drawing an upper drawer out, settling concerns about damage on the cover and/or the drawer.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a refrigerator main body having a cooling chamber;

a cooling chamber door to open and close the cooling chamber;

area storage member disposed at a rear area of the cooling chamber; and a front storage member disposed at a front of the rear storage member and movable in back and forth directions along the cooling chamber with respect to the rear storage member, wherein the rear storage member and the front storage member are implemented as a rear tray and a front tray, respectively, each having a storage space therein, and the refrigerator further comprises connection links to couple the front tray to the rear tray such that the front tray is movable up and down with respect to the rear tray, wherein the connection links are disposed at both sides of each of the front tray and the rear tray, and wherein for each of the both sides, the connection links comprises:

a rear link having one end coupled to a rear portion of the rear tray and an other end coupled to a rear portion of the front tray; and a front link disposed below the rear link and the front link having one end coupled to a front portion of the rear tray and an other end coupled to a front portion of the front tray.

2. The refrigerator of claim 1, further comprising rails to guide the rear tray and the front tray back and forth, and wherein each of the rails comprises a fixed rail fixed to the cooling chamber, and a movable rail retractably coupled to the fixed rail.

3. The refrigerator of claim 2, wherein the front tray comprises front link receiving portions to receive front end portions of the rear link and the front link, respectively, and wherein the rear tray comprises rear link receiving portions to receive rear end portions of the rear link and the front link, respectively.

4. The refrigerator of claim 3, wherein the front tray slides along the movable rail and when the movable rail is stopped after being slid to a front of the fixed rail by a predetermined length, the front tray moves down with respect to the rear tray.

5. The refrigerator of claim 4, wherein the front link comprises a horizontal section extending from the rear portion of the rear tray toward the front tray, and an inclined section inclined from the horizontal section toward the rear portion of the front tray, and the rear link comprises an inclined section upwardly inclined from the rear portion of the rear tray, and a horizontal section horizontally extending from the inclined section toward the front portion of the front tray.

6. The refrigerator of claim 5, wherein the rear link and the front link contact each other at least along the respective inclined sections of the rear link and the front link to support the front tray when the front tray is moved down.

7. The refrigerator of claim 6, wherein contact surfaces are formed at a lower end of the rear link and an upper end of the front link, respectively.

8. The refrigerator of claim 1, wherein the rear storage member is implemented as a rear shelf disposed at a rear area of the cooling chamber, and the front storage member is implemented as a front shelf movable with respect to the rear shelf, and the refrigerator further comprises support members to support the front shelf and the rear shelf, wherein the support members provide support to the front shelf when the front shelf extends from the rear shelf, and provide for the front shelf to be disposed below the rear shelf when the front shelf is retracted to the rear shelf.

9. The refrigerator of claim 8, wherein each of the support members comprises a guide portion configured to guide the front shelf to and from the extended position to the retracted position.

10. The refrigerator of claim 9, wherein a plurality of protrusions are formed on a lower surface of the rear shelf, and protrusion receiving portions to receive the protrusions therein are formed on the support members.

11. The refrigerator of claim 10, wherein the protrusions comprise front protrusions formed on a front area of the rear shelf, and rear protrusions formed on a rear area of the rear shelf.

12. The refrigerator of claim 11, wherein the rear shelf is perpendicularly rotatable based on the rear protrusions.

13. The refrigerator of claim 8, wherein a single plate-shaped shelf is disposed above or below the rear shelf and the front shelf.

14. The refrigerator of claim 13, wherein the single plate-shaped shelf, the rear shelf and the front shelf are formed of a rigid material.

15. The refrigerator of claim 14, wherein the single plated-shaped shelf, the rear shelf and the front shelf are formed of glass, each having a corrosion-processed portion formed by corrosion processing with respect to at least one surface thereof.

16. The refrigerator of claim 1, further comprising:

a drawer disposed in the cooling chamber;

a cover disposed on the drawer; and a cover driving unit to allow the cover to be slidable upon drawing the drawer out.

17. The refrigerator of claim 16, wherein the cover driving unit comprises:

a pinion;

a first rack disposed on the drawer and engaged with the pinion; and a second rack disposed on the cover and engaged with the pinion.

18. The refrigerator of claim 16, wherein the cover driving unit comprises:

a belt connected to the cover and the drawer, respectively; and a plurality of pulleys to movably support the belt.

19. The refrigerator of claim 18, wherein the cover driving unit comprises a power transfer piece having one side connected to the belt and an other side protruding toward the drawer, and wherein the drawer comprises a non-contact section non-contactable with the power transfer piece along a rotating direction of the belt.

20. A refrigerator comprising:

a refrigerator main body having a cooling chamber;

a cooling chamber door to open and close the cooling chamber;

a rear storage member disposed at a rear area of the cooling chamber;

a front storage member disposed at a front of the rear storage member and movable in back and forth directions along the cooling chamber with respect to the rear storage member;

a drawer disposed in the cooling chamber;

a cover disposed on the drawer; and a cover driving unit to allow the cover to be slidable upon drawing the drawer out, wherein the cover driving unit comprises:

a belt connected to the cover and the drawer, respectively; and a plurality of pulleys to movably support the belt, wherein the cover driving unit comprises a power transfer piece having one side connected to the belt and an other side protruding toward the drawer, and wherein the drawer comprises a non-contact section non-contactable with the power transfer piece along a rotating direction of the belt.

* * * * *